US006544049B1

(12) United States Patent
Pierson, Jr.

(10) Patent No.: US 6,544,049 B1
(45) Date of Patent: Apr. 8, 2003

(54) ELECTRICAL UNIT FOR MATING WITH AN ELECTRICAL BOX

(75) Inventor: Forrest L. Pierson, Jr., Dallas, TX (US)

(73) Assignee: WorldCom, Inc., Clinton, MS (US)

( * ) Notice: Subject to any disclaimer, the term of this patent is extended or adjusted under 35 U.S.C. 154(b) by 0 days.

(21) Appl. No.: 09/695,097

(22) Filed: Oct. 24, 2000

(51) Int. Cl.[7] ..... H01R 4/66; H01R 13/648; H01R 29/00

(52) U.S. Cl. ..... 439/107

(58) Field of Search ..... 439/107, 188, 439/106, 650, 680

(56) References Cited

U.S. PATENT DOCUMENTS

| | | | | |
|---|---|---|---|---|
| 257,277 | A | | 5/1882 | Bergmann |
| 2,214,065 | A | | 9/1940 | Pennock et al. |
| 2,430,011 | A | | 11/1947 | Gillentine |
| 2,751,568 | A | | 6/1956 | Despard |
| 2,828,394 | A | | 3/1958 | Mayzik |
| 2,908,743 | A | | 10/1959 | Premoshis |
| 2,920,303 | A | | 1/1960 | Johnson |
| 3,004,175 | A | | 10/1961 | Weiss |
| 3,157,732 | A | | 11/1964 | Richards |
| 3,167,375 | A | | 1/1965 | Sarazen |
| 3,189,636 | A | | 6/1965 | Leach |
| 3,482,263 | A | | 12/1969 | Ryder |
| 3,588,489 | A | | 6/1971 | Gaines |
| 3,609,647 | A | | 9/1971 | Castellano |
| 3,702,982 | A | | 11/1972 | Kelly et al. |
| 3,922,478 | A | | 11/1975 | Perkey |
| 4,117,258 | A | | 9/1978 | Shanker |
| 4,304,957 | A | | 12/1981 | Slater et al. |
| 4,352,537 | A | | 10/1982 | Guelden |
| 4,379,605 | A | | 4/1983 | Hoffman |
| 4,674,819 | A | | 6/1987 | Fujitani et al. |
| 4,740,167 | A | | 4/1988 | Millhimes et al. |
| 4,985,806 | A | | 1/1991 | Mazzullo et al. |
| 5,141,449 | A | | 8/1992 | Tieszen |
| 5,229,220 | A | * | 7/1993 | Stanton et al. ..... 429/1 |
| 5,425,659 | A | * | 6/1995 | Banks ..... 439/650 |
| 5,429,518 | A | * | 7/1995 | Chen ..... 439/188 |
| 5,471,012 | A | | 11/1995 | Opel |
| 5,648,712 | A | * | 7/1997 | Hahn ..... 320/2 |
| 5,729,436 | A | | 3/1998 | Yoshigi et al. |
| 6,010,347 | A | | 1/2000 | Lee |
| 6,045,399 | A | * | 4/2000 | Yu ..... 439/502 |
| 6,086,408 | A | | 7/2000 | Tanigawa |
| 6,172,428 | B1 | * | 1/2001 | Jordan ..... 290/40 C |
| 6,201,187 | B1 | | 3/2001 | Burbine |

* cited by examiner

*Primary Examiner*—Neil Abrams
*Assistant Examiner*—Chandrika Prasad

(57) ABSTRACT

An electrical unit including a body having a device surface and a mating surface. An electrical device configured to provide an electrical function to a user is arranged on the device surface, and neutral and hot contacts configured to receive respective neutral and hot conductive members of an electrical box are mounted on the mating surface. The electrical device may be any one of an outlet, a switch, circuit breaker, or any combination of these devices. In addition to the neutral and hot contacts, ground and alternative contacts may be provided on the mating surface and each contact may be a rigid electrical socket oriented in a keyed configuration so as to electrically connect to the respective conductive members without the use of connecting wires when the electrical unit is mated with the electrical box. The electrical unit may include a mating screw which, when tightened in a screw hole of the electrical box, causes the electrical unit to mate with the electrical box, and a non-conductive member mounted on the mating surface which prevents the electrical unit from mating with a non-compatible electrical box.

26 Claims, 14 Drawing Sheets

ELECTRICAL UNIT FOR MATING WITH AN ELECTRICAL BOX

BACKGROUND OF THE INVENTION

1. Field of the Invention

The present invention relates to an electrical unit for providing electrical functions to a user, and more particularly relates to an electrical box that enables efficient installation and replacement of electrical units of a building.

2. Discussion of the Background

In providing electrical power to commercial and residential buildings, a main power line typically carrying 100–200 Amps of 220 VAC single phase power enters the building from an electric company power grid and is connected to a service box that distributes power to the entire building. In the service box, the 220 VAC power is center tapped with a neutral return to provide two 110 VAC sources of opposite polarity and ground terminal connected to the earth.

In the service box, power from the main power line is divided into branch circuits each of which typically provides 110 VAC power circuit breakered at 15 to 25 Amps to several plugs, switches, and/or other electrical units located in different areas of the building. In providing such branch circuits, multi-conductor electrical cable must be routed from a branch circuit breaker in the main service box to electrical boxes that contain each of the electrical units in the branch circuit. The multi-conductor cable used to route the branch circuits typically includes a white insulation neutral wire, a black insulation hot wire, and a bare or green insulation ground wire to carry 110 VAC throughout the building. In branch circuits, in which 220 VAC are used, a red insulation alternative hot wire is also provided in the multi-conductor cable, and higher currents are allowed for certain high power appliances, such as stoves, ovens, air conditioners, heaters and clothes dryers.

Current practice in wiring a branch circuit is to route individual segments of the multi-conductor electrical cable from the interior of one electrical box to the interior of a subsequent electrical box in the circuit. When all electrical boxes are connected with cable segments, the free ends of the cable segments at the interior of each box are connected to complete the branch circuit. In completing the branch circuit, the outer insulation sheathing is first stripped off of each free end of cable to expose the internal electrical wires, and the insulation is then stripped off of the end of each wire to expose the copper conductor of the wire. The bare conductors of each wire are then connected by use of twist-on connectors or by connecting the conductor to a switch, plug, or other electrical unit in the box and the cables are folded within the interior of the box to make room for the electrical unit.

Similarly, when a new load, such as an electrical outlet is added to an existing electrical circuit, wires of the existing circuit must be spliced into and reconnected by use of the added load. Specifically, in adding a load, the electrician must first cut an opening in the finished wall to reveal the existing electrical cable which is then cut to provide two ends of the cable which are inserted into an electrical box used for housing the electrical outlet to be added. In situations whereby the electrical cable is not long enough that the ends of the cable can reach the interior of the new electrical box, it may be necessary for the electrician to install at least one junction box to extend the ends of the cable. The ends of the cable are then prepared and the internal wires are stripped as described above. The wire ends are reconnected through the electrical unit in the box to complete the circuit, and the wires are folded into the new box as discussed.

These conventional methods of wiring a building, however, present a number of problems to the electrician and homeowner. First, from the standpoint of the electrician, the effort it takes to cut and route cable segments between electrical boxes, and then to strip and reconnect the internal wires of the cable using the above-described method is very time consuming and labor intensive. In addition, in installing a new electrical outlet, existing wires may have to be extended by use of a junction box requiring extra time. In addition, because multi-conductor electrical cables have three or four individually insulated conductors bound together by an outer sheathing, the cable is stiff and difficult to fold into the electrical box in such a way that plugs, switches, and other electrical units will have enough room to fit in the box. This creates greater inefficiency and makes it difficult for the electrician to sufficiently align all of the plugs and/or switches in a multi-ganged box so that a cover plate can be placed over the electrical unit and box.

In addition to the above-described efficiency problems, a significant amount of wire is wasted in routing all branch circuits from one main service box to each branch circuit region that the service box is to power. For example, providing power to the top floor of a large home may require two 15 Amp branch circuits in which case two multi-conductor electrical cables need to be routed from the main service box located in the basement, for example, to the area powered by each circuit. Distributed service panels that may resolve this problem have not been feasible in such situations due to their expense and large size that is not desirable for living space. Although to a lesser extent, electrical wire is also wasted when cable ends must be extended to reach the interior of a new electrical box when adding a load to an existing circuit.

From the home or building owner's standpoint, with the hundreds of electrical connections inside even a small house, the complicated method of cutting and stripping cables and internal wires as described above is likely to result in at least one poor connection that will eventually fail. The possibility of a poor connection is also present for the addition of new outlets. The failure of such a poor connection can be as benign as denying electrical service to all downstream electrical boxes in the circuit or as disastrous as causing a house to bum down. Moreover, nicking, or cutting into, of a conductor of each wire may occur each time insulation is cut off the wire to expose bare copper for the connection. This reduces the wire surface area available for carrying electrical current and can cause localized overheating, with the potential to start a fire. Reduced surface area may also cause a significant voltage drop that slows down motors, dims lights, or affects the operation of voltage sensitive appliances.

In addition, because the multi-conductor electrical cable enters each electrical box and must be connected to the electrical unit and folded within the box, space inside each electrical box is limited thereby limiting the number and sophistication of features offered by the electrical units used with the electrical box. Finally, replacement of electrical units may be problematic for the above-described system because it is common for electrical wires to break when being removed from the electrical unit to be replaced. This shortens the length of wire within the electrical box making it difficult or impossible to connect the new electrical unit without extending the length of wire with a splice.

Based on the foregoing, there is a clear need for an electrical unit that provides safe and reliable electrical functions for a user in a home and/or commercial building.

There is also a need for an electrical unit that mates with an electrical box without the use of electrical wires that occupy space within the electrical box.

Finally, there is a need for an electrical unit having sophisticated features yet is easy to align within the electrical box so that a decorative cover can be attached to the electrical box.

SUMMARY OF THE INVENTION

According to one aspect of the invention, an electrical unit for mating with an electrical box is provided. The electrical unit includes a body having a device surface and a mating surface. An electrical device configured to provide an electrical function to a user is arranged on the device surface, and neutral and hot contacts configured to receive respective neutral and hot conductive members of an electrical box are mounted on the mating surface. The electrical device may be any one of an outlet, a switch, circuit breaker, or any combination of these devices. In addition to the neutral and hot contacts, ground and alternative contacts may be provided on the mating surface and each contact may be a rigid electrical socket oriented in a keyed configuration so as to electrically connect to the respective conductive members without the use of connecting wires when the electrical unit is mated with the electrical box. The electrical unit may include a mating screw which, when tightened in a screw hole of the electrical box, causes the electrical unit to mate with the electrical box, and a non-conductive member mounted on the mating surface which prevents the electrical unit from mating with a non-compatible electrical box.

According to another aspect of the present invention, the electrical unit includes a means for containing electrical circuitry, the means having a device surface and a mating surface. A means for providing an electrical function to users is arranged on the device surface, and means for receiving neutral and hot conductive members of an electrical box are mounted on the mating surface. The means for providing an electrical function may be any one of a means for providing electrical power, means for switching electrical power, means for interrupting electrical power, or any combination of these means. In addition to the means for receiving neutral and hot conductive members, means for receiving ground and alternative hot conductive may be provided on the mating surface, and each of these means may be in a keyed configuration so as to electrically connect to the respective conductive members without the use of connecting wires when the electrical unit is mated with the electrical box. The electrical unit may include means for fastening the electrical unit to the electrical box, and means for preventing the electrical unit from mating with a non-compatible electrical box.

In still another aspect of the present invention, a method of connecting an electrical unit that provides an electrical function to an electrical box is provided. The method includes aligning neutral and hot contacts of the electrical unit with respective neutral and hot conductive members of the electrical box, and press fitting the neutral and hot contacts to mate with the respective conductive members such that electrical contact is made between the electrical unit and the electrical box without the use of electrical wires. The method may also include aligning a mating screw of the electrical unit with a screw hole in the electrical box so that press fitting is accomplished by turning the mating screw in the screw hole such that the electrical unit is pulled into mating with the electrical box.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
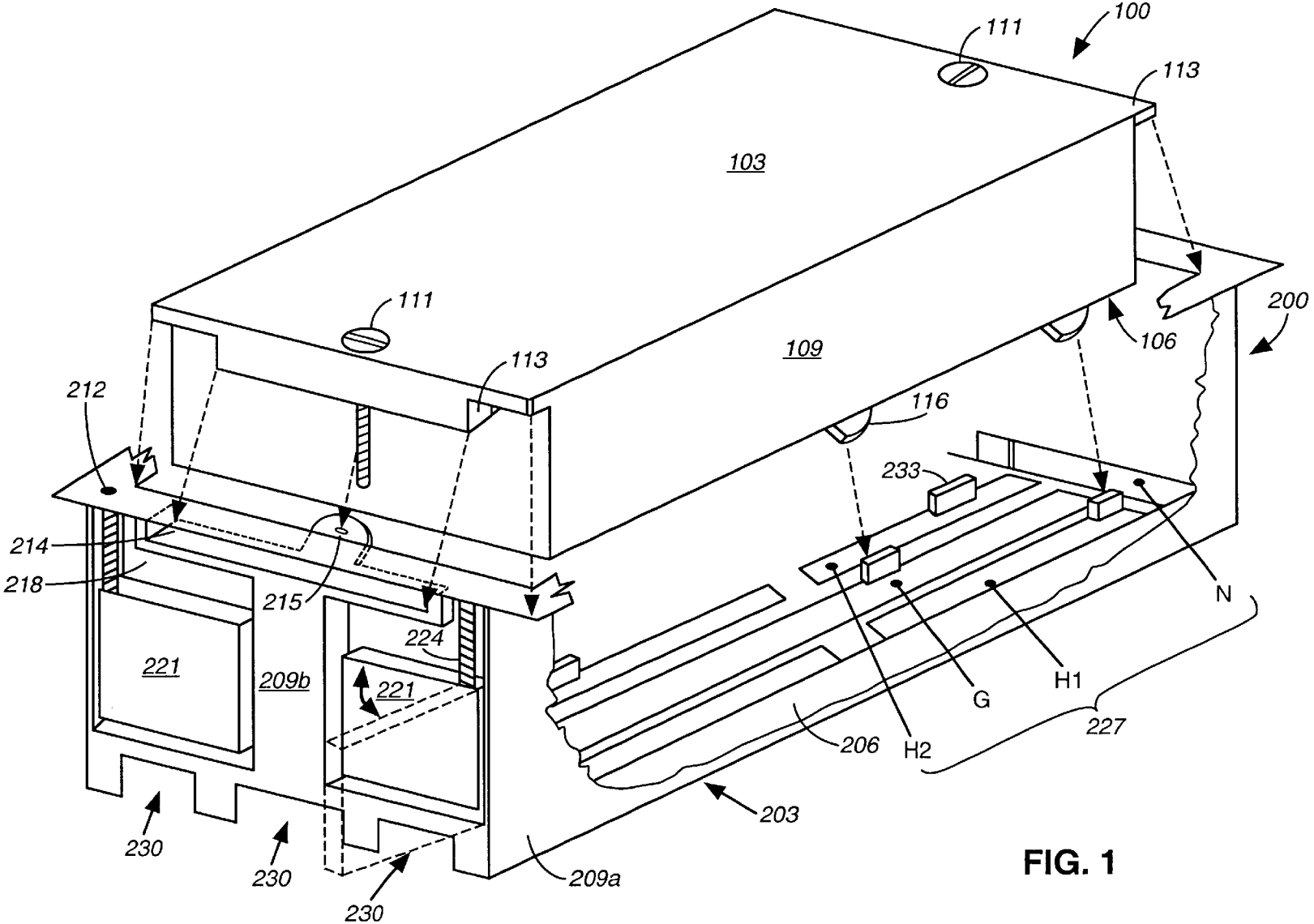
FIG. 1 is a perspective view of an electrical unit mating with an electrical box in accordance with an embodiment of the present invention.

Referring now to the drawings, wherein like reference numerals designate identical or corresponding parts throughout the drawings, an electrical unit and electrical box for providing efficient and reliable wiring of a building, is shown. An embodiment of this invention is shown in FIG. 1, which is a perspective view of an electrical unit 100 mating with an electrical box 200 according to the present invention.

The electrical unit 100 includes a front face (device surface) 103 and an opposing mating surface 106 joined by a unit sidewall 109. The front face 103 receives two mating screws 111 each of which penetrate a mating edge 113 that protrudes from the unit sidewall 109 in a direction parallel to the front face 103 of the electrical unit 100. Mounted on the mating surface 106 of the electrical unit 100 is a plurality of sockets 116 made of an electrically conductive material. The electrical unit 100 is preferably constructed of a rigid plastic or any suitable electrically insulating material.

The electrical box 200 includes a main body 203 having a conductor carrying surface (i.e., carrier) 206 and box sidewalls 209*a* and endwalls 209*b* that protrude at right angles from the conductor carrying surface 206 to define an open ended cavity for receiving electrical unit 100. A seating lip 212 protrudes substantially perpendicularly from the box sidewalls 209*a* and endwalls 209*b* around a perimeter of the opening of the electrical box 200 and provides a mating surface for the mating edge 113 of the electrical unit 100. Likewise, tabs (only one shown) including a screw hole 215 are mounted to an interior surface of each endwall 209*b* in a position of the endwall suitable for receiving the mating screw 111 of the electrical unit 100.

Box endwalls 209*b* of the electrical box 200 include recessed paddle openings 218 positioned adjacent to fastening paddles 221 rotatably mounted to an interior surface of the box sidewall 209*b* via a shaft 224. As seen by the phantom paddle in FIG. 1, the fastening paddles 221 may be rotated to protrude from box endwall openings 218 to fasten the electrical box 200 to a finished wall as will be further described. While only one endwall 209*b* is shown to include the recessed paddle openings 218 and paddles 221, it is to be understood that that this fastening structure will is be included on the opposing endwall 209*b* as well. Moreover, the fastening structure may be provided a sidewall 209*a* in addition to or in lieu of endwall 209*b*.

Mounted on an interior surface of the conductor carrier 206 are a plurality of interior bus bars 227. Each bus bar 227 is electrically connected to one of a neutral, hot, ground, or alternative hot electrical wire of a multi-conductor electrical cable carrying building power, by connectors mounted on an exterior surface of the conductor carrier 206 as will be described. The multi-conductor cable is routed to the electrical box 200 by way of cable channels 230 provided on an underside of the electrical box 200. As seen in FIG. 1, the interior neutral bus bars, hot bus bars, ground bus bars, and alternative bus bars are represented by the reference designations N, H1, G, and H2 respectively. Moreover, these reference designations are used to represent the conductivity type of various components of the invention throughout the several drawings. Mounted on each bus bar 227 is a conductive member 233 in electrical contact with the bus bar 227 to which it is mounted. Conductive members 233 are positioned in a suitable configuration to receive the conductive sockets 116 of the electrical unit 100 when the electrical unit 100 is fully mated with the electrical box 200. The dashed arrows of FIG. 1 indicate mating surfaces of the electrical unit 100 and electrical box 200 in FIG. 1.

Figure 2:
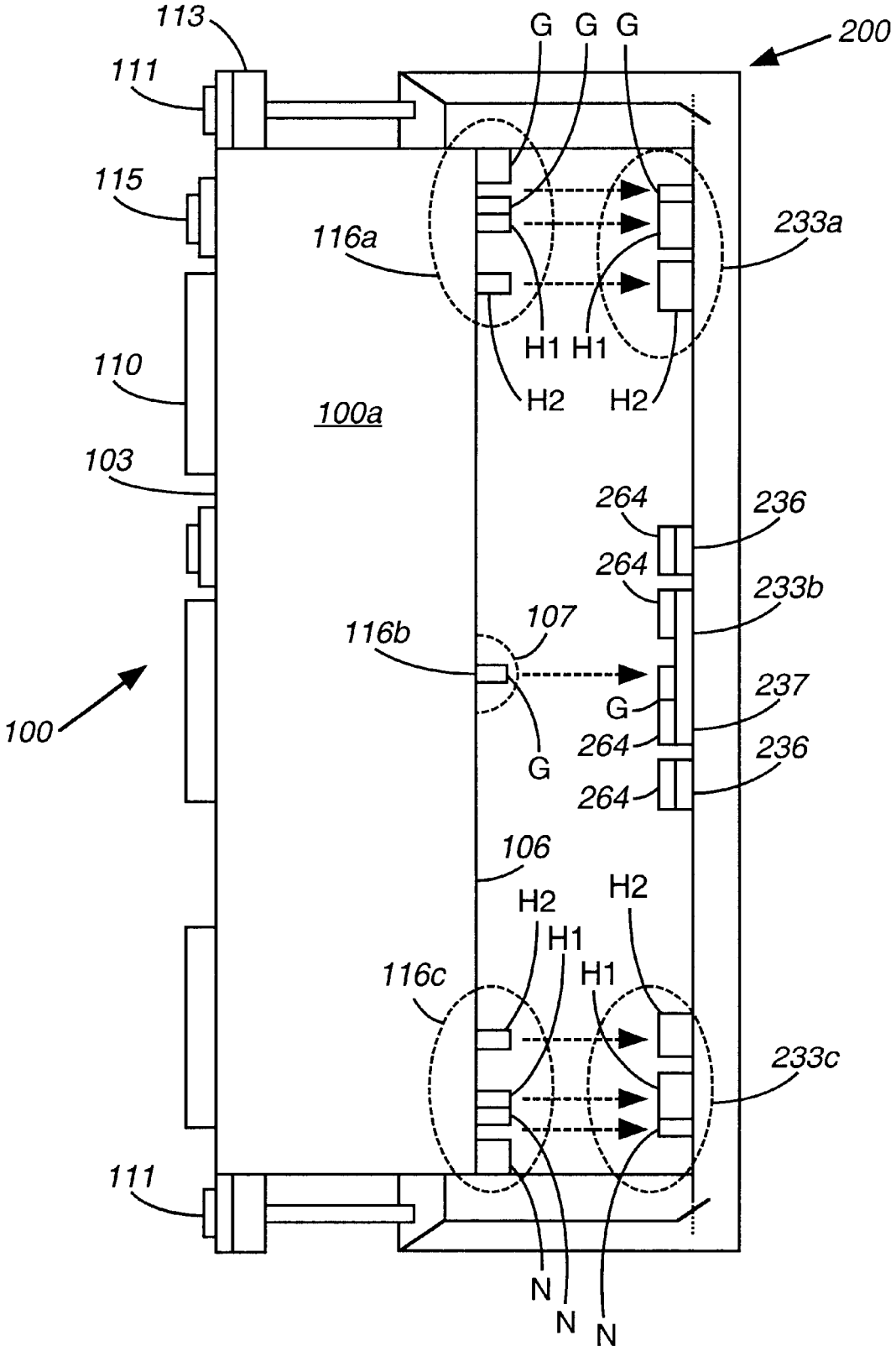
FIG. 2 is a side view of an electrical unit partially mated with an electrical box in accordance with an embodiment of the present invention.

FIG. 2 depicts a side view of an electrical unit 100 mating with an electrical box 200 according to the present invention. A portion of the box sidewall 209 of the electrical box is removed to reveal interior connections between the electrical unit 100 and electrical box 200. Also shown are mating screws 110 penetrating the mating edge 113 of the electrical unit 100 and inserted into the electrical box 200 as discussed with respect to FIG. 1.

The electrical unit 100 having a body 100*a* as shown in FIG. 2 is a circuit breakered six outlet plug module, however, it is to be understood that many types of electrical units may be used in accordance with the present invention as will be described. Mounted on the front face 103 of the electrical unit 100 are electrical outlets (electrical devices) 110 and push button circuit breaker switches 115, each of which corresponds to a respective electrical outlet 110. Conductive sockets 116 on the mating surface 106 are grouped in groups 116*a*, 116*b*, and 116*c* to indicate a vertical positioning of the conductive sockets 116. Similarly, the conductive members 233 mounted on the interior bus bars 227 (not shown in FIG. 2) are grouped in groups 233*a*, 233*b*, and 233*c* to show a vertical positioning of the conductive members 233 within the electrical box 200. The conductivity type of each conductive socket 116 and each conductive member 233 is indicated by the reference designations N, H1, G, and H2 as previously discussed.

According to the present invention, building power is present on the conductive members of 233 of the electrical box 200 via connections (not shown in FIG. 2) on the back side of the electrical box and is transferred to the electrical unit 100 by way of the conductive sockets 116 which make electrical contact with the conductive members 233 when the electrical unit 100 is mated with the electrical box 200. Accordingly, as shown in FIG. 2, the conductive sockets 116 are configured on the mating surface 106 such that each of the conductive sockets 116 mates with a same conductivity type conductive member 233 each of which is also suitably configured on the interior surface of the conductor carrier 206. The dashed arrows of FIG. 2 indicate the approximate mating contact of the conductive sockets 116 with the conductive members 233 when the electrical unit 100 is mated with the electrical box 200.

The electrical unit 100 may include a non-conductive block 107 shown in phantom as a safety feature which prevents a non-compatible electrical unit from mating with a particular electrical box 200. For example, if electrical box 200 is configured to be a high current box, as will be described below, then electrical units 100 not rated for high current preferably would include non-conductive blocks 107 positioned such that they obstruct the mating of the electrical unit 100 with the electrical box 200. It is to be understood that the non-conductive blocks 107 are exemplary only in FIG. 2 as the electrical unit 100 of FIG. 2 is compatible with a high current box due to the circuit breaker switches 115. An end view of conductive horizontal tabs 236 and a side view of conductive vertical tab 237 are also shown in FIG. 2. The conductive tabs 236 and 237 are removably fastened to the bus bars 227 of the conductor carrier 206 by #4 or #6 flat head screws 264 as will be discussed.

Figure 3A:
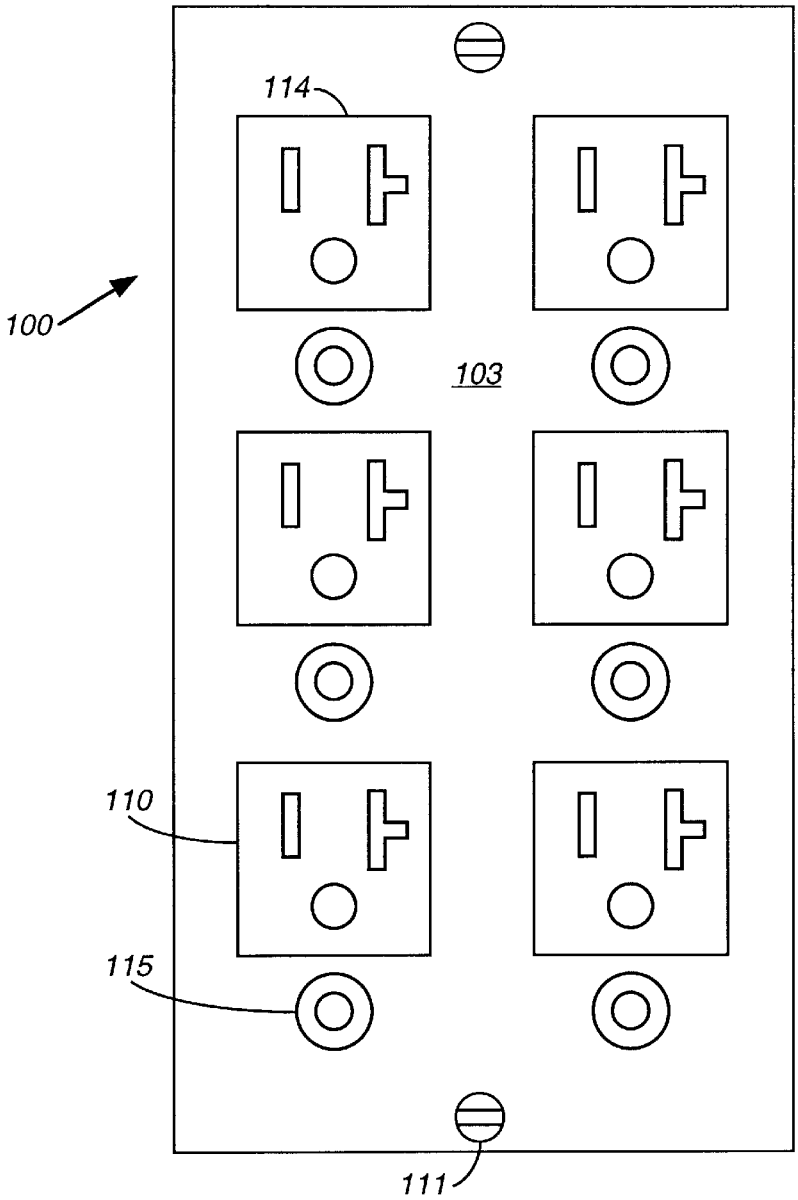
FIGS. 3A and 3B are a front face view and an end view respectively of an electrical unit in accordance with an embodiment of the present invention.
Figure 3B:
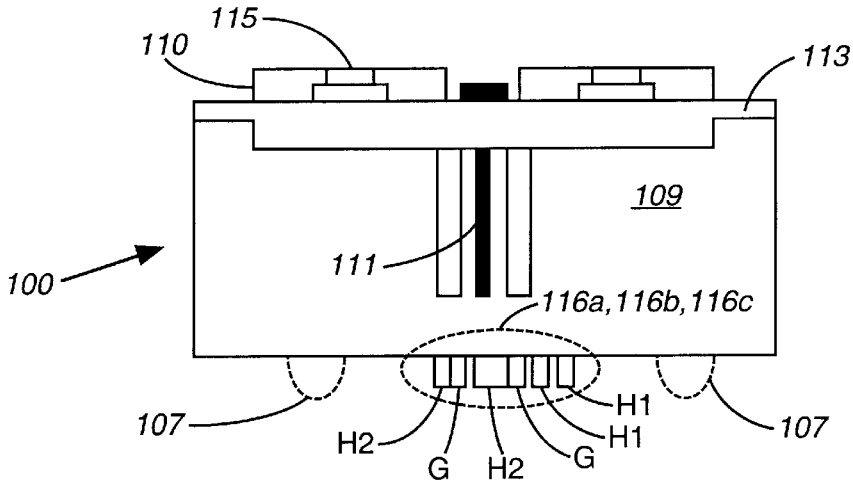

FIGS. 3A and 3B depict a front face view and a bottom end view respectively of the electrical unit 100 of FIG. 2. As seen in FIG. 3A, the six electrical outlets 110 are positioned vertically in 3 horizontal pairs on the front face 103 of the electrical unit 100. Each of the electrical outlets 110 is a standard 110 VAC 20 amp outlet used in household wiring and each outlet has a corresponding push button breaker switch 115. Each push button breaker switch 115 is designed to pass electrical power to its corresponding electrical outlet when the switch is in a depressed position, and to block power when in an out or tripped position. FIG. 3B shows the horizontal positioning of the conductive sockets 116 on the electrical unit 100. The conductive sockets 116 shown in FIG. 3B are conductive sockets included in groups 116*a*, 116*b*, and 116*c* of FIG. 2; however, conductive sockets that would obstruct the non-conductive blocks 107 (or bumps) have been removed so that positioning of the non-conductive bumps 107 can be clearly seen.

Figure 4:
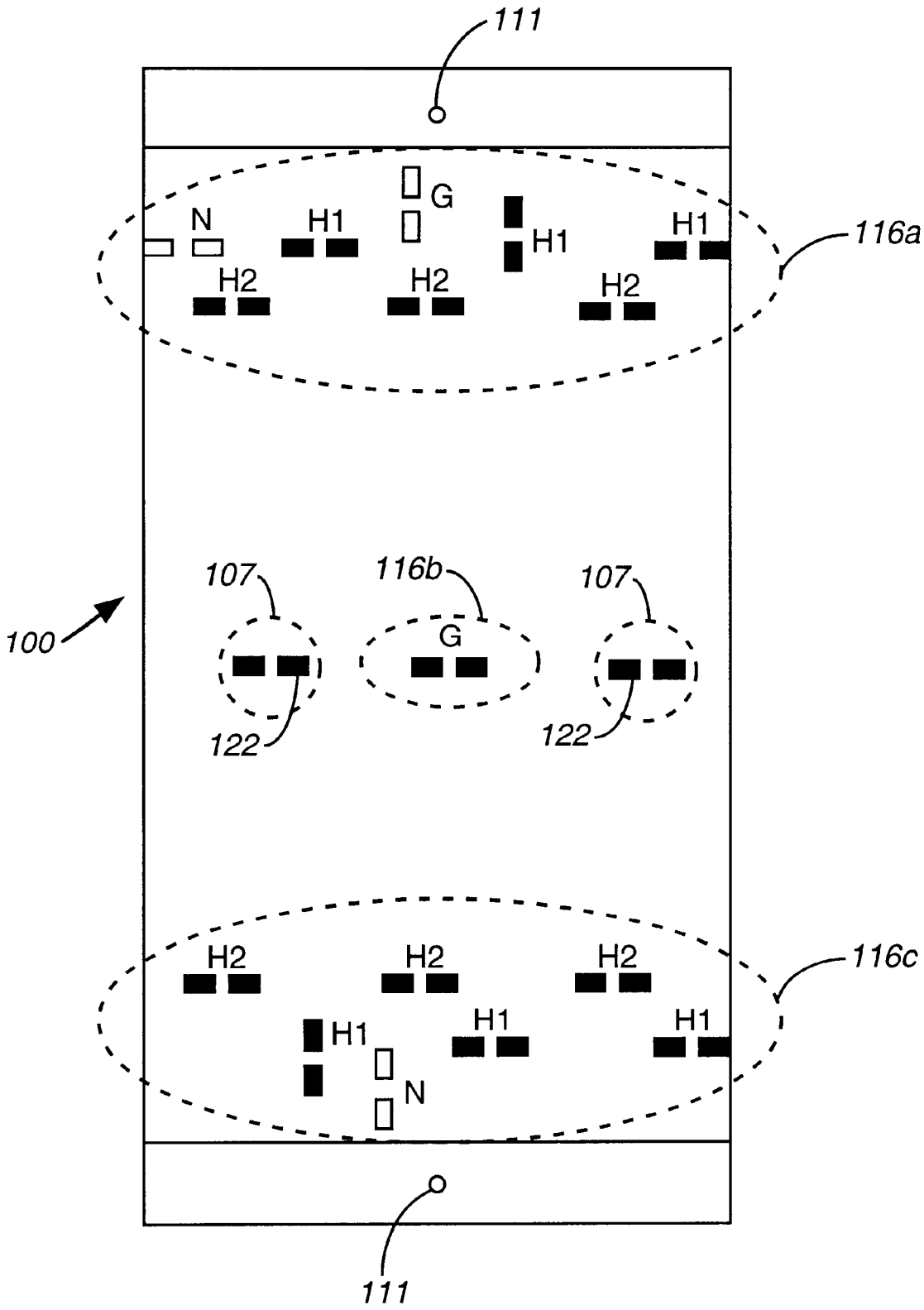
FIG. 4 is a bottom view of an electrical unit in accordance with an embodiment of the present invention.

FIG. 4 is a bottom view of electrical unit 100 showing the positioning of conductive sockets 116, some of which are oriented in same or different directions, on the mating surface 106 of the electrical unit. Conductive sockets 116*a*, 116*b*, and 116*c* correspond to the conductive sockets having the same reference designations in FIG. 2. In particular, H1 and H2 designate the hot sockets of the conductive sockets 116*a* and 116*c*, while N designates the neutral sockets of the conductive sockets 116*a* and 116*c*. The non-conductive blocks 107 are positioned on each side of the ground socket 116*b*. As described above, these non-conductive blocks 107 provide a safety feature that prevents a non-high current unit from mating with a high current electrical box. The non-conductive blocks 107 may be replaced with conductive ground sockets on high current electrical units as shown by the phantom sockets 122 in FIG. 4. The threaded ends of mating screws 111 are also shown in this figure.

Figure 5A:
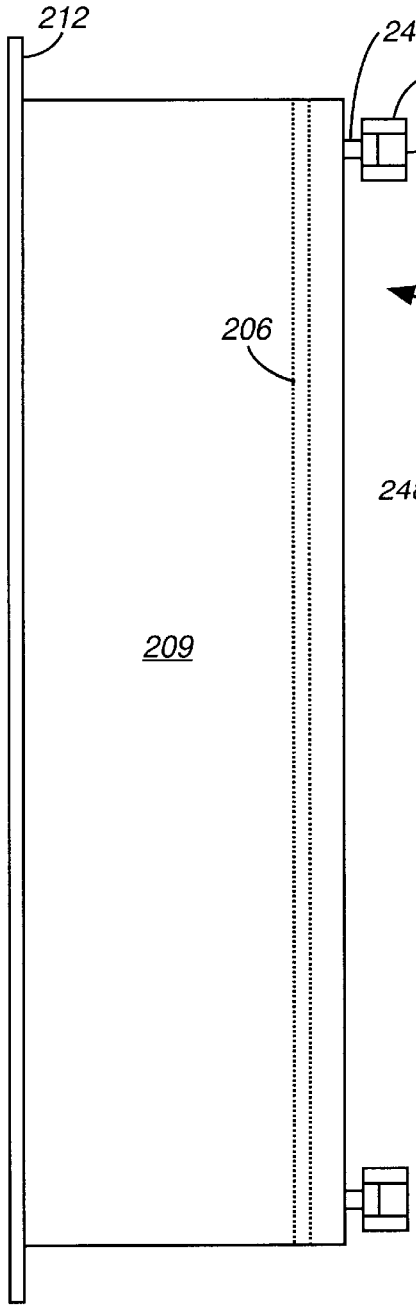
FIGS. 5A and 5B are a side view and an end view respectively of an electrical box in accordance with an embodiment of the present invention.
Figure 5B:
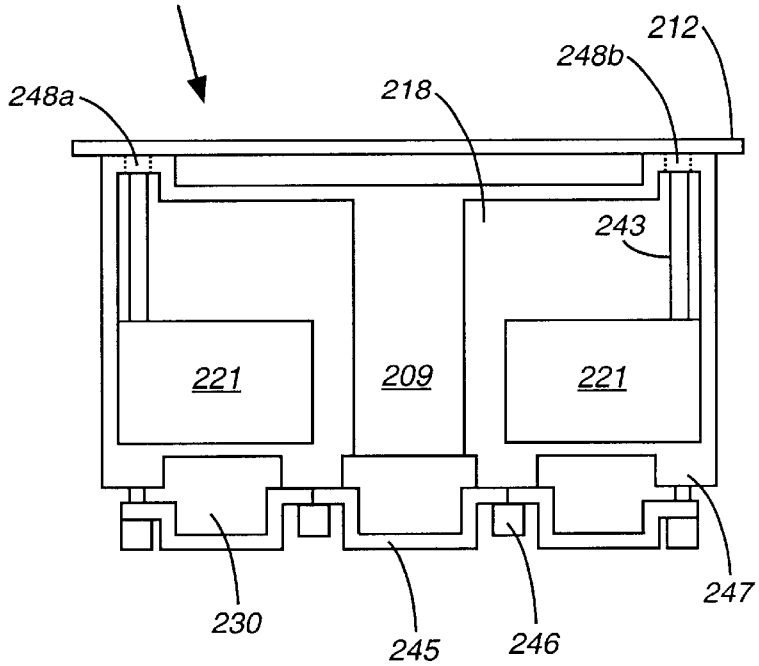

FIGS. 5A and 5B show a side view and an end view of the electrical box 200 respectively. As seen in these figures, conductor carrier 206 is inset from the back surface of the cavity defined by the box sidewalls 209*a* of the electrical box 200. As best seen in FIG. 5B, the conductor carrier 206 is inset at least enough so that it does not obstruct the cable channels 230. It is to be understood, however, that the inset depth of the conductor carrier 206 and the cable channels 230 may be varied depending on the application of the present invention. For example, in high current applications, the electrical cable used may include wires of a large gauge in which case the cable channels 230 and the conductor carrier 206 are of suitable dimensions for the larger cable. Likewise, it is to be understood that the depth of the cavity of the electrical box 200 may be of any size suitable to receive an electrical unit. The depth of the cavity is preferably slightly less than the width of the framing lumber used to form the wall that the electrical box is to be inserted into so that maximum space is provided for the electrical unit 100.

Cable clamps 245 are provided for clamping electrical cables that enter and exit the electrical box 200. The cable clamps 245 are removably mounted opposing the cable channels 230 by way of cable clamp screws 246. Spacers 247 allow a back cover plate to be installed over the back side of the electrical box 200 as will be described.

As shown in phantom in FIG. 5B, fastening screws 248 are connected to each shaft 243 for rotating paddles 221 into and out of a fixing position as described with respect to FIG. 1. One fastening screw 248*a* will turn clockwise to extend the paddle 221 out, then up so the paddle 221 and the seating lip 212 will clamp onto the wall the electrical box 200 is being inserted into. The same screw 248*a* will turn counter clockwise to release the paddle 221 and swing it back into the recessed area (i.e., opening) 218 so the electrical box 200 can be removed from the wall. The other screw 248*b* on the same end side will turn counter clockwise to extend it's paddle 221 out and pinch the wall against it and seating lip 212, and turn clockwise to release the wall and swing the paddle 221 back into the recessed area 218. Both screws 248*a* and 248*b* are shown, however, for single gang electrical box 200 only one screw with it's associated paddle 221 may be used. In multi-gang boxes 300 (as will be discussed in FIG. 12) one paddle 221 and screw 248 may be adjacent to each comer between endwall 209*b* and sidewall 209*a*.

Figure 6:
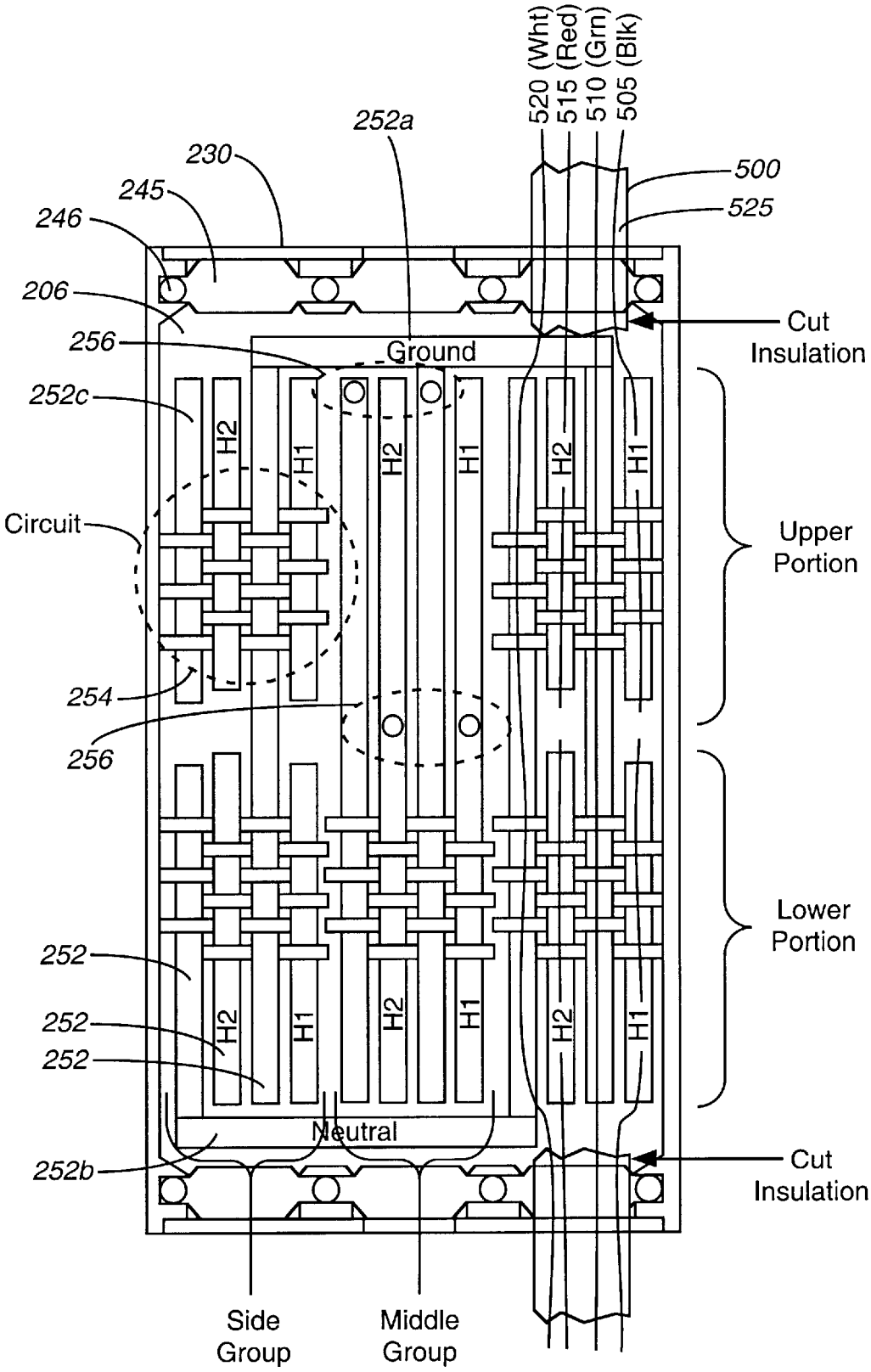
FIG. 6 is a back view of an electrical box in accordance with an embodiment of the present invention.

FIG. 6 is a back view of the electrical box 200 having a multi-conductor cable 500 attached thereto. The multi-conductor cable 500 includes insulated wires 505, 510, 515, and 520 within an outer insulation sheathing 525 shown as transparent in FIG. 6. Wires 505, 510, 515, and 520 are labeled as black, green, red, and white respectively according to the typical color scheme of multi-conductor electrical cables used in the USA. A back view of cable clamps 245 (also transparent where necessary) and cable clamp screws 246 is also shown. Although the electrical box 200 of FIG. 6 shows three sets of cable clamps 245, it is to be understood that any number of cable clamps 245 may be provided in order to allow a number of cables sufficient to provide power to the electrical box 200 to pass through the electrical box.

Mounted on conductor carrier 206 are a plurality of conductive exterior bus bars 252 each of which corresponds to one of hot, neutral, ground, and alternative hot conductivity as indicated by the "H1", "N", "G", and "H2" referenced. The external bus bars 252 are grouped into a continuous middle group, and two side groups, each of which is separated into lower and upper portions. Only one side group is labeled in FIG. 6 to avoid obscuring the multi-conductor cable 500. The lower and upper portions of each side group have electrically independent hot and alternative hot external bus bars 252. A horizontal ground bus bar 252*a* electrically connects all of the vertically oriented ground bus bars within the electrical box 200. Similarly, a neutral joining bus bar 252*b* electrically connects all neutral bus bars in the electrical box with the exception of one neutral bus bar 252*c* that is isolated from other neutral bus bars of the electrical box and is used for ground fault circuit interruption applications as will be discussed.

A plurality of insulation displacement connectors (IDCs) 254 are positioned on each external bus bar 252. The IDCs 254 are preferably knife blade type connectors that provide a gas tight electrical connection with insulated wires 505, 510, 515, and 520 which are press fitted into the IDC connectors 254. The IDC connectors 254 are preferably configured to accept wires having a wire gauge from 14 to 10, and each IDC 254 is preferably capable of carrying 15 A. As seen in FIG. 6, the IDCs 254 are provided in sets of three to provide redundancy in the event that one of the knife blades does not make a proper connection with a wire. This allows a single IDC 254 in any group of three to fail while the other two IDCs in the group can still carry 30A between them. Sets of IDCs 254 on an exterior bus bar 252 of a particular conductivity type are staggered with respect to IDCs 254 of an adjacent exterior bus bar 252 of a different conductivity type in order to minimize the possibility of shorting between exterior bus bars. As also seen in FIG. 6, these staggered sets of IDCs 254 provide a single circuit suitable for wiring a branch circuit off of the electrical box 200 as will be described.

High current screw holes 256 on each of the exterior bus bars 252 of the middle group, are configured to receive a clamp type wire connector (not shown). The clamp type wire connectors clamp down on a bare conductor of wires 505, 510, 515, and 520 to provide electrical contact when a screw of the connector is fastened to the screw hole 256. These connectors are used in high current applications where IDC connectors 254 have insufficient current capacity. The high current screw holes 256 are preferably rated to carry 60 A of current and are used to hold wire clamps that can be connected to 8, 6 or 4 gauge wire which carry 40 A, 55–60 A, and 70 A capacity respectively. All bus bars 252 in the middle group of FIG. 6 preferably carry 40 A while all other bus bars in the each of the side groups are preferably rated to carry 30 A. Current from the screw holes 256 can flow in multiple directions on each bus bar 252 so that the bus bars do not have to carry as much current as the high current screw holes 256.

Figure 7:
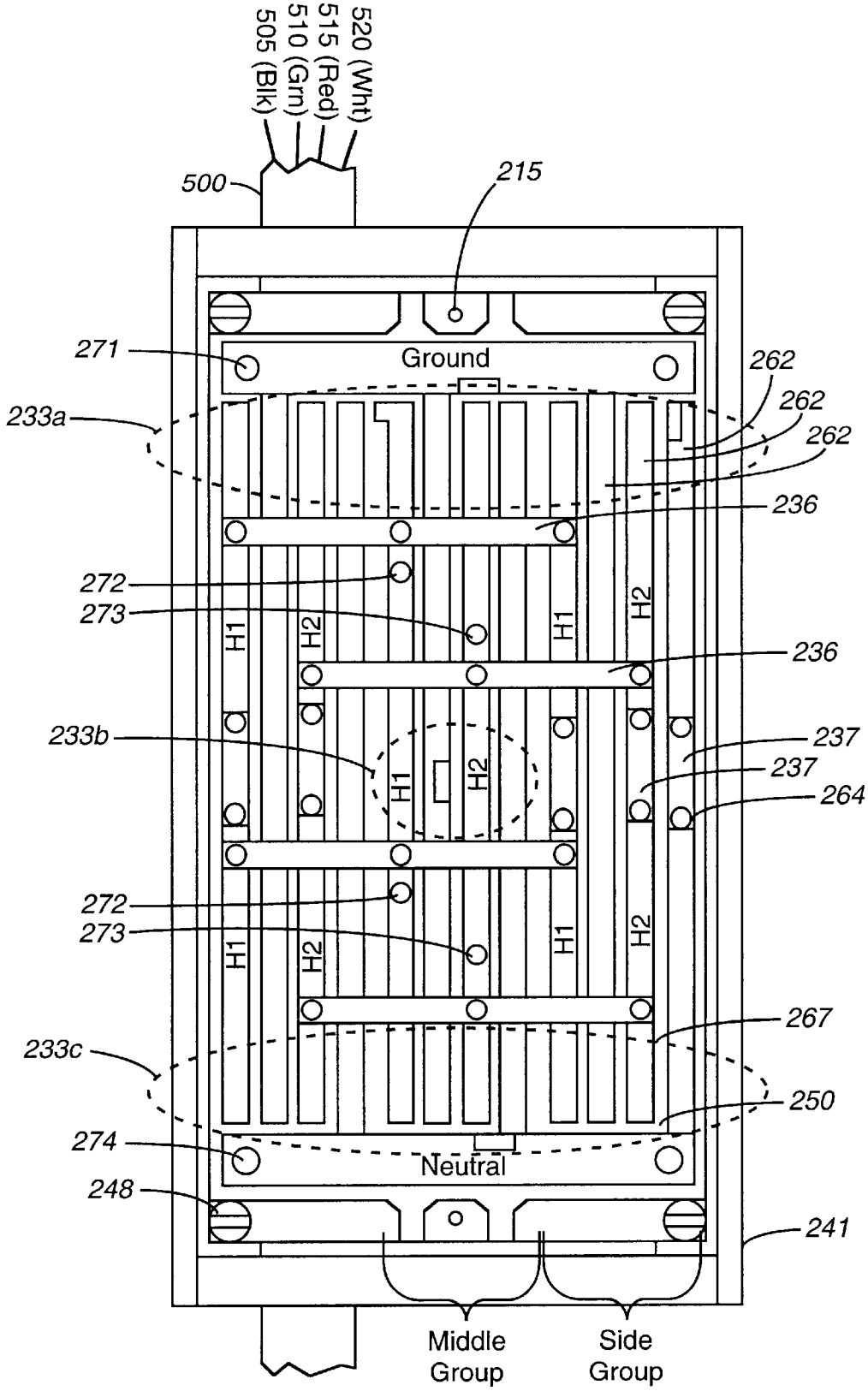
FIG. 7 is a front view of an electrical box in accordance with an embodiment of the present invention.

FIG. 7 is a front view of the electrical box 200 of FIG. 6 connected to multi-conductor cable 500. A plurality of interior bus bars 227 each of which corresponds to a hot, neutral, ground, and alternative hot are mounted on an interior surface of conductor carrier 206. It is noted that the neutral (N), alternative hot (H2), and ground (G) interior bus bars indicated by the referenced designator 227 of FIG. 7 correspond to the neutral, alternative hot, and ground exterior bus bars indicated by the reference designation 252 of FIG. 6. Moreover, the middle and side groups of interior bus bars 227 of FIG. 7 correspond to the middle and side groups of exterior bus bars 252 shown in FIG. 6. While the exterior bus bars 252 of FIG. 6 and the interior bus bars 262 of FIG. 7 are shown as occupying the same area on opposing sides of the conductor board 250, it is to be understood that it is not necessary for these bus bars to occupy the same area as long as electrical connection is made between corresponding internal and external bus bars. Moreover, it is to be understood that the internal bus bars 262 and external bus bars 252 may be mounted on separate substrates rather than a single conductor carrier 206. Thus, corresponding elements of FIGS. 6 and 7, such as cable 500, are positioned on opposite sides of each figure due to rotation of the electrical box 200 to obtain the back and front views of FIGS. 6 and 7 respectively. A front view of paddle screws 248 are also shown in FIG. 7 along with screw holes 215 positioned in the tabs discussed with respect to FIG. 1. Also shown in shade is seating lip 212 positioned along the perimeter of an opening to the electrical box 200.

Removable conductive tabs 236 and 237 are mounted between interior bus bars 262 by use of #4 or #6 flat head screws depicted by the circles 264. Each conductive tab 262 is preferably rated for 30 A. Horizontal tabs 236 are used to distribute power from the hot and alternate hot interior bus bars 262 of the middle group to hot and alternative hot interior bus bars 262 in each side group respectively. Removable tabs 237 are positioned vertically to electrically connect the upper portion of each side group of interior bus bars 262 to a lower portion within the same side group when needed. Safety ground has no vertical tab bar because ground is common through an entire electrical box. Neutral has one vertical removable tab 237*a*, on one of the side groups which is used with a ground fault circuit interrupter (GFCI). Tab 237*a* allows the neutral of a GFCI outlet to be isolated so that in the event of a ground fault it can disconnected from the balance of the neutral.

A plurality of conductive members 233 protrude from the conductor carrier 206 of the electrical box 200 to allow mating with the electrical unit 100 as described with respect to FIG. 1. End views of the conductive members 233 are shown as small rectangular boxes within respective interior bus bars 262 that are grouped into groups 233*a*, 233*b*, and 233*c*. Each of these groups corresponds to the conductive members having the same reference designation in FIG. 2. The conductive members 233 are oriented in a horizontal and vertical direction in order to allow mating of similarly oriented conductive sockets 116 on the electrical unit 100 which have the same conductivity type. The conductive members 233 preferably carry up to 60 A for the electrical unit. Multi gang screw holes 271, 272, 273, and 274 are positioned in the ground, hot, alternative hot, and neutral interior bus bars 262 respectively to allow for mounting gang to gang removable tabs as will be further discussed below.

Figure 8:
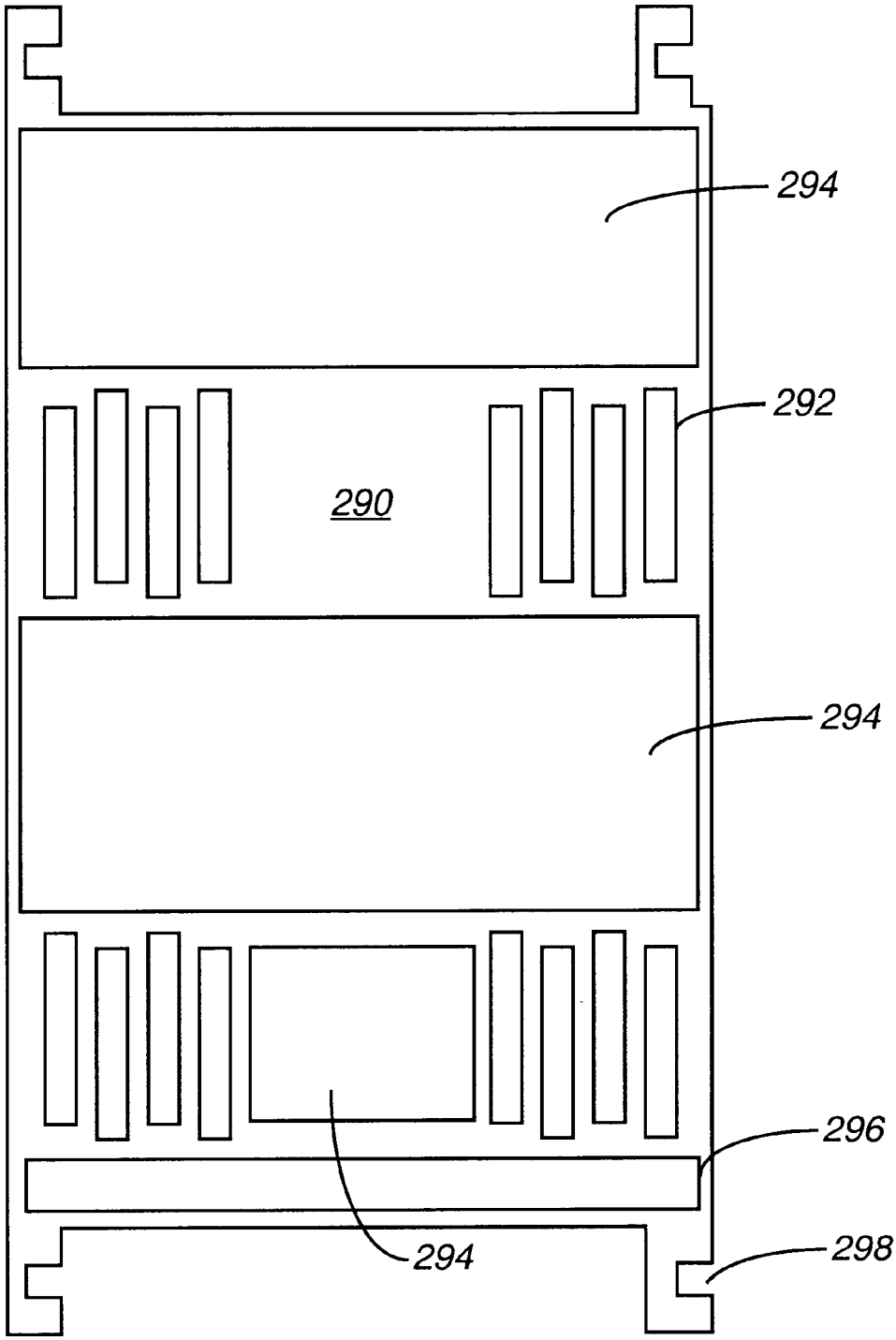
FIG. 8 is an interior view of an electrical box cover plate in accordance with an embodiment of the present invention.

FIG. 8 shows a cover plate used to cover the IDCs 254, connected wires, and other components of the back side of the electrical box 200. Sets of push bars 292 are preferably mounted within the cover plate 290 to hold down smaller gauge wires onto the knife blades of IDCs 254. These push bars 292 are placed in different positions depending on the configuration of the electrical box 200 and may be removed if all of the wires entering the electrical box 200 are larger than 10 gauge thereby requiring high current wire clamps to be used as previously discussed. Cavities 294 provide recessed areas for large gauge wires and wire clamps, and further provide stiffening for the push bars 292. A stiffener 296 may be added in areas of the cover plate 290 not having a cavity 294. The cover plate 290 also includes a notched tab 298 that mates with the spacers 247 (shown in FIG. 4B) to hold the cover plate 290 onto the electrical box 200. Preferably the cover plate 290 can work with both the standard electrical box 200 and high current electrical box 200' (FIG. 9), although if this is not possible separate cover plates can be provided.

Figure 9:
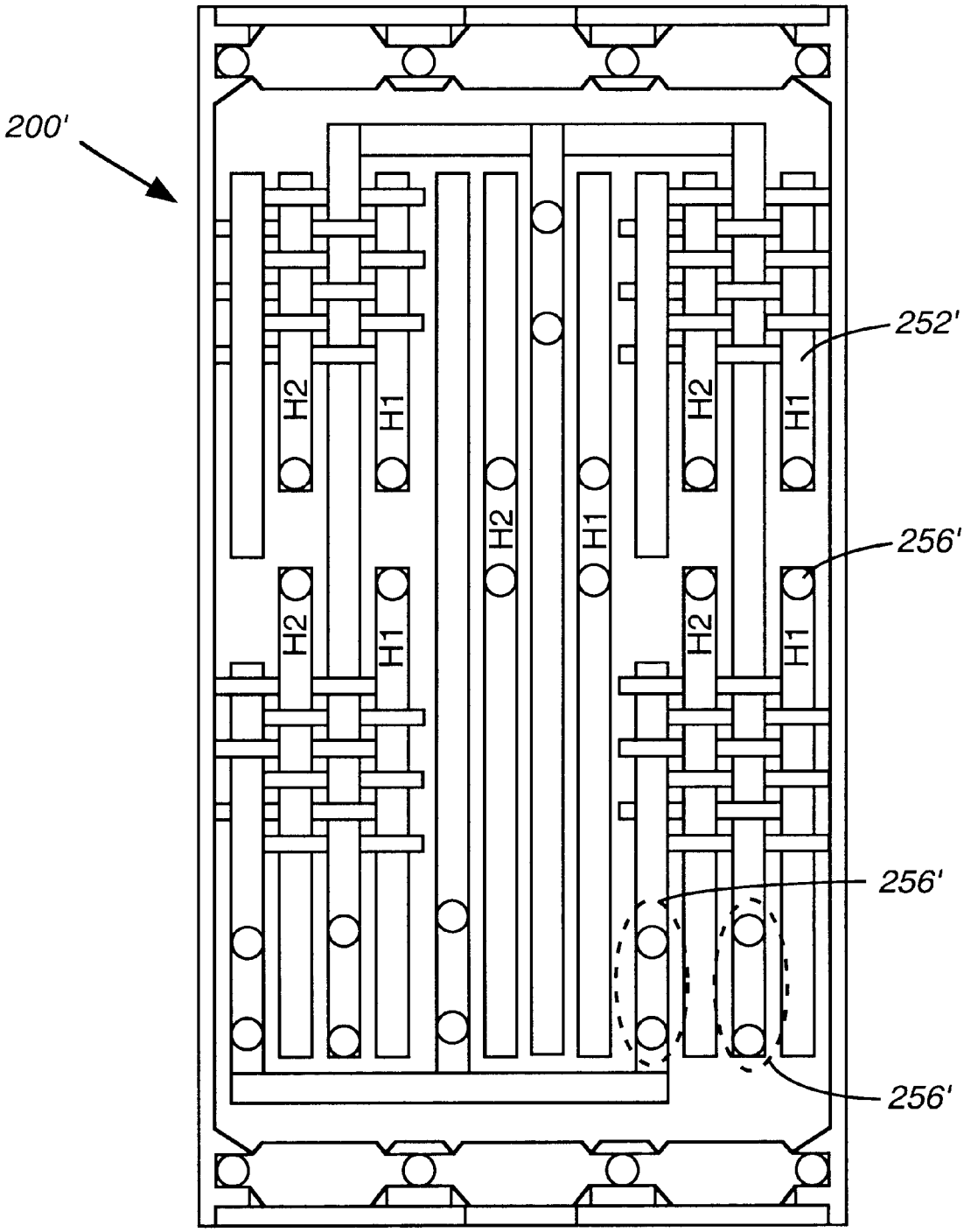
FIG. 9 is a back view of a high current electrical box in accordance with an embodiment of the present invention.

FIG. 9 is a back view of a high current electrical box according to an embodiment of the present invention. The high current electrical box 200' is similar to the electrical box 200 previously described but can carry up to 60 A per bus bar. Description of components of the high current electrical box 200' that are similar to the corresponding components of the electrical box 200 are omitted in order to avoid obscuring the differences between these two embodiments. As seen in FIG. 9, a pair of screw holes 256' are provided for each ground and neutral bus bar 252' as well as the hot and alternative hot bus bars of the middle group. Upper and lower hot and alternative hot bus bars 252' of each side group have only one screw hole 256'. As with the high current screw holes 256 of the electrical box 200, the screw holes 256' are provided for mounting wire clamps to the exterior bus bars 252'. All bus bars 252' and screw holes 256' preferably carry up to 60 A, or 6 gauge wires. By paralleling two screw holes 256', up to 100 A can pass through the high current electrical box 200' using 2 gauge wires. This also connects together the lower and upper hot and alternate hot bus bars. The high current electrical box 220' can accommodate four 220 VAC circuit breaker/switches of up to 60 A, or eight 110 VAC circuit breaker/switches of up to 30 A.

Figure 10:
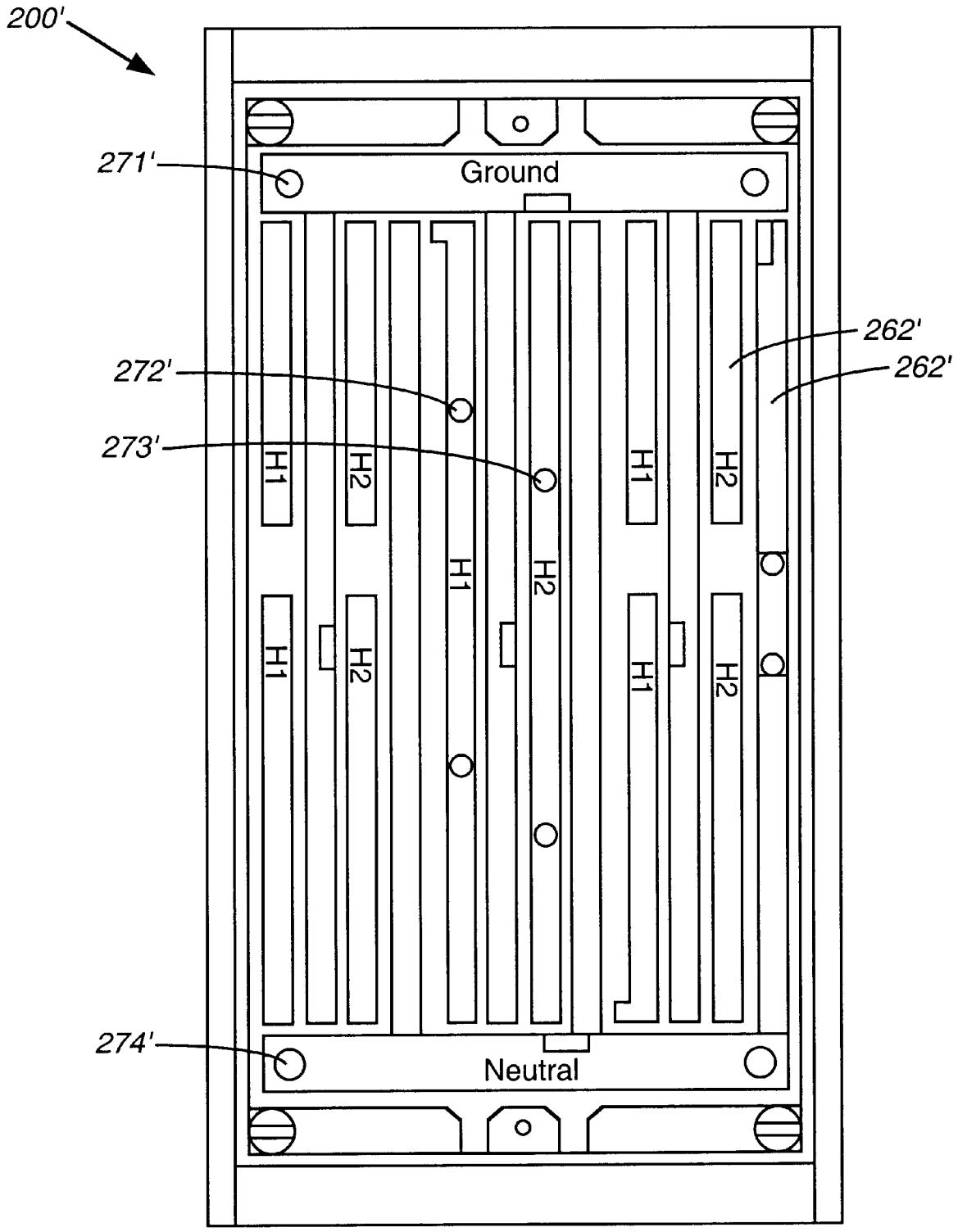
FIG. 10 is a front view of a high current electrical box in accordance with an embodiment of the present invention.

FIG. 10 is a front view of the high current electrical box 200' according to the present invention. In the high current box 200', the neutral and safety ground are enclosed on opposite ends on the front side versus the back side. This allows 60 A rated bus bars to carry 100 A by having half the current flow in one direction while the other half flows in the other direction. As with the electrical box 200, multigang screw holes 271', 272', 273', and 274' are positioned in the ground, hot, alternative hot, and neutral interior bus bars 262' respectively to allow for mounting gang to gang removable tabs as will be described below. Each removable tab of the high current electrical box 200' carries 60 A. One cross bus bar is needed for carrying currents up to 60 A, while both cross bus bars are needed to carry currents above that. The high current electrical box 200' does not include any horizontal conductive tabs and includes only one vertical removable tab 237*a* on the neutral bus bar 262' for use in GFCI applications as discussed above.

Each conductive member 233' of the high current electrical box 200', like the electrical box 200, will carry up to 60 A. The conductive members 233' are positioned at locations identical to those of the non-high current version, except that extra ground tabs 122 are added as discussed with respect to FIG. 4. As also discussed, any electrical unit (switch, plug, circuit breaker, etc) not intended for use in a high current electrical box 200' only will have a non-conductive block 107 that prevents the electrical unit being pushed into a high current electrical box 200' because the extra conductive members 122 occupy the space the non-conductive blocks 107 take up in a mating position.

A functional description of the electrical unit 100 and the electrical box 200 will now be given by reference to the exemplary situation in which an additional load, such as a 110 VAC electrical outlet, is added to an existing electrical circuit in a home or building. While the below description assumes that an electrician installs the new load, the present invention makes such an installation simple enough for a homeowner or other non-electrician to accomplish.

In the above-described example, the electrician first determines the location of electrical cable of an existing circuit behind a finished wall based on electrical plans or the position of existing outlets and local electrical codes if plans are not available. A wall opening is then cut in the finished wall in a desired area in close proximity to the existing cable. The wall opening is preferably cut using a template to ensure that the opening is slightly larger than the main body 203 of the electrical box 200, yet smaller than the seating lip 212. Once the wall opening is cut, insulation, vapor barrier and other debris is removed from the opening to expose the electrical cable. The exposed cable is then pulled through the wall opening as much as possible in preparation for connection to the electrical box 200.

The exposed power cable is sized against the back side of the electrical box 200 and markings are placed on the cable to designate a length of the cable that will be stripped of outer insulation sheathing. As seen in FIG. 6, the amount of insulation sheathing 525 removed is preferably of sufficient length to expose the internal wires 505, 510, 515, and 520 of the cable 500 to the IDCs 254, but short enough so that the outer sheathing of the cable 500 can be clamped within the cable clamps 245. The position at which the outer insulation sheathing 525 is stripped off the cable is indicated by the arrows in FIG. 6. As is known to one of ordinary skill in the art of electrical wiring, the insulated wires of the cable 500 are typically color coded whereby a hot wire 505 which is black, a ground wire 510 is green or a bare conductor, an alternative hot wire 515 is red, and a neutral return wire 520 is white as indicated in FIG. 6. It is to be understood that not all wires are necessary to realizing the advantages of the present application. For example, it is well known that the majority of wiring circumstances require only one hot wire in which case the cable 500 does not include the red alternative hot wire 515.

Once an optimum length of insulation is stripped from the cable 500, the cable is placed in an appropriate cable channel 230 and the cable clamp screws 246 are tightened down until the cable 500 is clamped snuggly between the cable channel 230 and the cable clamp 245. This relieves mechanical stress from electrical connections between the electrical box 200 and the wires of the cable 500 as required by the National Electric Code (NEC). Electrical connections are made by press fitting or punching down the wires 505, 510, 515, and 520 onto appropriate IDCs 254 in accordance with the color codes of the wires. In a preferred embodiment, the IDCs 254 and/or exterior bus bars 252 are color coded in coordination with the wires. Although FIG. 6 shows electrical cable 500 connected to the IDCs 254 of a side group, in adding an electrical outlet to an existing circuit, it is preferable to attach the power cable 500 to the middle group of exterior bus bars 252 as power needs to pass through the electrical box to feed downstream outlets of the existing circuit. A situation in which a cable is connected to a side group as shown in FIG. 6 will be discussed below with respect to new construction wiring.

With the insulated wires connected to the middle group of electrical box 200, back cover plate 290 is attached to the electrical box 200 to provide complete coverage of the cable clamps 245, exposed wires 505, 510, 515, and 520, and IDC connections as required by NEC. In attaching the cover plate 290, the cover plate is slid laterally into contact with the electrical box 200 such that notches 298 of the cover plate are fit snuggly around spacers 247.

With the cover plate 290 installed, the electrical box 200 is inserted into the wall opening cut to a suitable size as discussed. To insert the main body 203 of the electrical box 200 into the wall opening, fastening paddles 221 must be in a retracted position as shown by the solid lines in FIG. 1. The main body 203 is placed within the opening and the electrical box 200 is pushed into the hollow wall until the seating lip 212 is flush against the finished wall. While holding the seating lip 212 in a flush position, the paddle screws 248 are operated to rotate the fastening paddles 221 from a retracted position to a fastening position wherein the paddles protrude from the box sidewall openings 218 as shown by the phantom paddle in FIG. 1. With the paddles in a protruding position, the fastening paddles 221 abut against the interior side of the finished wall to securely fix the finished wall between the fastening paddle 221 and seating lip 212 to thereby hold the electrical box 200 in place. The distance between the protruding fastening paddle 221 and the opposing seating lip 212 is preferably ½ inch for use with ½ inch sheet rock finished wall; however, it is to be understood that this distance may be varied to accommodate a different finished wall thickness.

With the electrical box 200 fastened to the wall, the electrical unit 100 is pressed fitted into the electrical box 200 to complete the installation of a load to an existing circuit. Because the electrical box is connected to the finished wall as discussed above, and not to framing lumber, it is preferred that the mating force not be applied to the wall itself. Therefore, the electrician fastens the mating screws 111 of the electrical unit 100 with the screw holes 215 of the electrical box 200. The screws are then rotated in an alternating manner such that the electrical unit 100 is pulled into a mating position with the electrical box 200. Mating screws 111 may also be used to disconnect the electrical unit 100 from the electrical box 200. Alternately the electrical unit 100 may be mated with the electrical box 200 before the box is inserted into the wall cavity.

As best seen in FIG. 1, when the electrical box 200 is mated with the electrical unit 100, the mating edges of the electrical unit about the seating lip 212 and mating surface 214 of the electrical box 200. Electrical contact is also made between the conductive members 233 and the conductive sockets 116. A finished cover may be placed over the electrical unit 100 and seating lip 241 on the exterior of the finished wall to improve the aesthetics of the electrical unit 100 and box 200.

Thus, in adding a load to an existing circuit in a building, the electrical wires of the existing cable are quickly connected to the electrical box by punching the wires down onto the IDCs without cutting or stripping the wires. Moreover, the redundant IDCs provide a reliable gas tight electrical connection without the possibility of nicking that exists when stripping wires. Moreover, because the existing wires are not cut, it is unnecessary to provide a special junction box to provide wire extensions for the existing wires. Finally, by using the conductive member and conductive finger mating system, no wires enter the interior of the electrical box leaving more room for larger electrical units having more functions.

Improvements in new construction electrical wiring may also be realized by use of the electrical unit 100 and electrical box 200 according to the present invention. In such new construction wiring, a primary run of electrical cable is first routed from the service panel to a number of regions in the building. The electrical cable is preferably a four conductor cable rated to carry 220 VAC, 30 or higher amp, power from the service box to the different regions of the building and is routed in a continuous run without cutting the cable into segments. In routing the electrical cable through the different regions of the building, slack is preferably provided so that the cable may be pulled through a finished wall when an electrical box is attached to the electrical cable. Moreover, two or more primary 220 VAC lines may be needed for a particular building depending on the service requirement of the building and the amperage rating of the primary cable.

Once the 220 VAC 30 amp lines are routed, branch circuits are routed for each region according to a wiring plan. Each branch circuit is typically a three conductor 110 VAC line that is tapped into the hot or alternative hot power of the primary 220 VAC line. As with the primary 220 VAC line, each branch circuit line is a continuous line that begins at the area where it taps into the 220 VAC line and ends at the most remote outlet location in the branch. The branch lines are not spliced into the 220 VAC line, but rather are tied or taped to the 220 VAC line to maintain their position during subsequent phases of constructing the building.

The finished wall is then installed to cover the electrical wiring and any insulation installed in the wall. As there are no electrical boxes yet installed, installing the finished wall can be done more efficiently since the wall does not have to be cut around existing outlets as with prior art wiring processes. However, it is preferred that areas where the branch lines are taped or tied to the primary line be marked on the finished wall as the wall is installed.

After the wall is installed, a wall opening is cut at the marked area of the wall where the branch circuits meet the primary line and the primary line and branch lines are untied and pulled through the opening. The outer insulation is first stripped off of the primary 220 VAC line which is then connected to the middle group of exterior bus bars 252 as discussed above with respect to installing a new outlet to an existing line. The ends of the branch lines are then attached to the IDCs 254 on the upper and lower portions of the side groups of the electrical box 200. As shown in FIG. 6, a continuous branch cable line may be used to route two branch circuits off of a single side group of bus bars. In this case, the hot and/or alternative hot wires are cut to isolate the upper and lower circuits as also shown in FIG. 6. Four branch circuits carrying 220 VAC or preferably 110 VAC may be routed from the junction box using the four sets of IDCs 254 in the upper and lower portions of each side group of the electrical box 200.

Once the primary and branch lines are connected to the IDCs 254, the back cover 290 is installed to the electrical box 200 and the electrical box is fastened to the finished wall as previously discussed. With the electronic box fixed in the wall, the electrician then installs horizontal conductive tabs 236 to the interior of the electrical box according to the number and positioning of branch circuits attached to the IDCs 254. Specifically, where the upper portion of one side group is wired to a branch circuit, a horizontal tab 236 is connected between a hot bus bar of the middle group and a corresponding hot bus bar in the upper portion of the side group to which a circuit is wired by fastening the tab to a screw hole in each bus bar using #4 or #6 flat head screws. Where a lower portion of the same side group is also wired to a branch circuit, as shown in FIG. 6, a horizontal tab 236 is also connected between a hot bus bar of the middle group and a corresponding hot bus bar in the lower portion of the side group. It is to be understood that since the middle bus bars are wired with 220 VAC power, the side circuits used for 110 VAC branch circuits may be supplied power from either the hot or alternative hot bus bar of the middle group. For example, the horizontal tabs 236 of upper and lower circuits may each be fastened to the hot bus bar of the middle group, or the upper and lower bus bars of the side group may be connected to the hot and alternative hot bus bars of the middle group respectively.

Horizontal tabs 236 may also be connected depending on the type of electrical unit 100 to be used with the electrical box 200. For example, where the electrical unit 100 requires power from the hot and alternative hot bus bars of the upper and lower portions of each side group, four horizontal bus bars route power from the middle group to the side groups as shown in FIG. 7. In addition, vertical tabs 237 may be used to route power between upper and lower portions of a side group where isolation of the upper and lower portions is not needed.

Once the horizontal tabs 236 and vertical tabs 237 have been installed in the interior of the electrical box 200 as necessary, a switching unit 100 is mated with the electrical box 200 as discussed above. A decorative cover plate is then added to cover the electrical unit 100 and seating lip 212 of the electrical box.

Thus, in wiring a new construction building using an electrical box 200 and electrical unit 100 of the present invention, the electrical wires of the existing cable are quickly connected to the electrical box by punching the wires down onto the IDCs with minimal cutting and stripping of the wires. Moreover, the redundant IDCs provide a reliable gas tight electrical connection without the possibility of nicking that exists when stripping wires. Finally, by using the conductive member and conductive finger mating system, no wires enter the interior of the electrical box leaving more room for larger electrical units having more functions that may be planned for in a new construction home.

The present invention also provides an improved way of replacing an electrical unit that is broken or does not provide the desired electrical functions to a user. As discussed above, replacing conventional electrical units may be problematic because wires often break during removal from the unit to be replaced making it difficult or impossible to connect the wires to the new electrical unit without first extending the wires by splicing. An electrical unit according to the present invention can be replaced by simply removing the decorative cover plate and un-mating the electrical unit 100 from the electrical box 200. This is preferably accomplished by unscrewing mating screws 111 from screw holes 215. The head of each screw 111 is attached to the electrical unit 100 such that unscrewing pulls the electrical unit 100 apart from the electrical box 200. A new electrical unit 100 is then aligned with the electrical box 200 such that the sockets 116 align with the conductive members 233. Screws 111 are then mated with screw holes 215 and rotated to pull the electrical unit 100 into mating contact with the electrical box 200 as described above.

According to the present invention, a variety of modules may be plugged into the electrical box 200 or 200' in order to achieve a variety of electrical functions.

FIGS. 11A through 11E depict typical electrical units 100 used with an electrical box 200 or high current electrical box 200' according to the present invention. The various electrical units 100 all have mating screws located on the top and bottom of the unit to pull the electrical unit 100 into mating contact with the electrical box 200 as previously discussed. Mounting holes for screws that hold on the decorative cover plates are omitted for clarity.

Figure 11B:
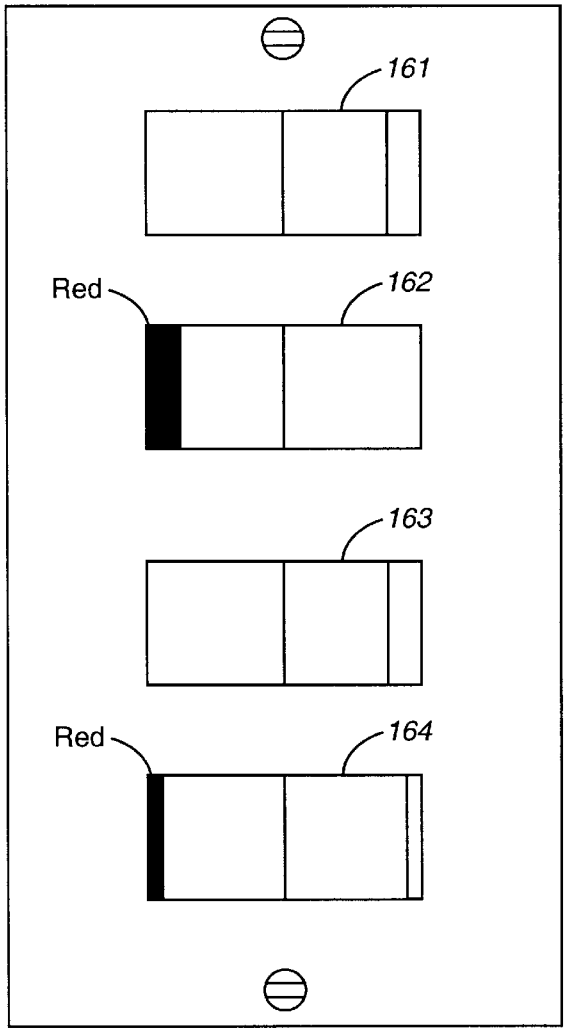
FIGS. 11A through 11E are front face views of electrical units according to an embodiment of the present invention.
Figure 11A:
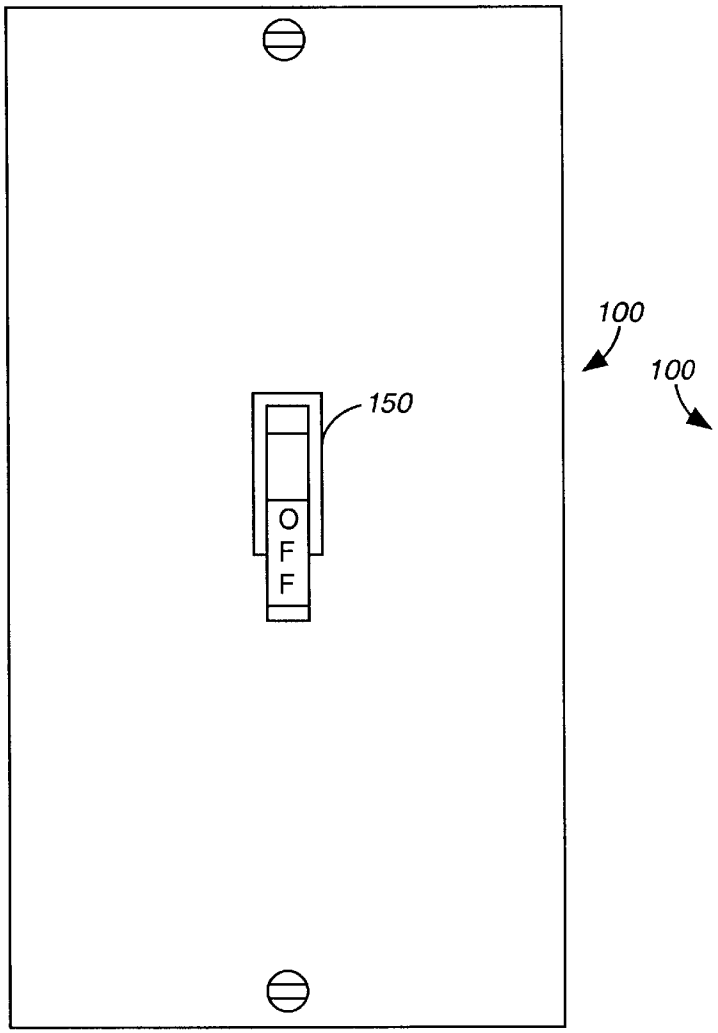

As seen in FIG. 11A, the electrical box may be used with a standard switch 150 to switch electrical power to a light or other electrical appliance. The switch 150 may switch 110 VAC or 220 VAC power of high or low current depending on the capacity of the electrical unit itself and the configuration of the electrical box the unit is plugged into.

FIG. 11B shows a quad switch or circuit breaker electrical unit that may be used with the electrical box 200 or high current electrical box 200'. The circuit breaker version preferably has one side showing red if the breaker is off or tripped. In FIG. 11B, the first breaker 161 is on, the second circuit breaker 162 is off, the third circuit breaker 163 is on, and the fourth circuit breaker 164 is tripped or halfway between on and off. Each circuit breaker can optionally have lighted indicators for indicating on, or off/tripped.

Figure 11C:
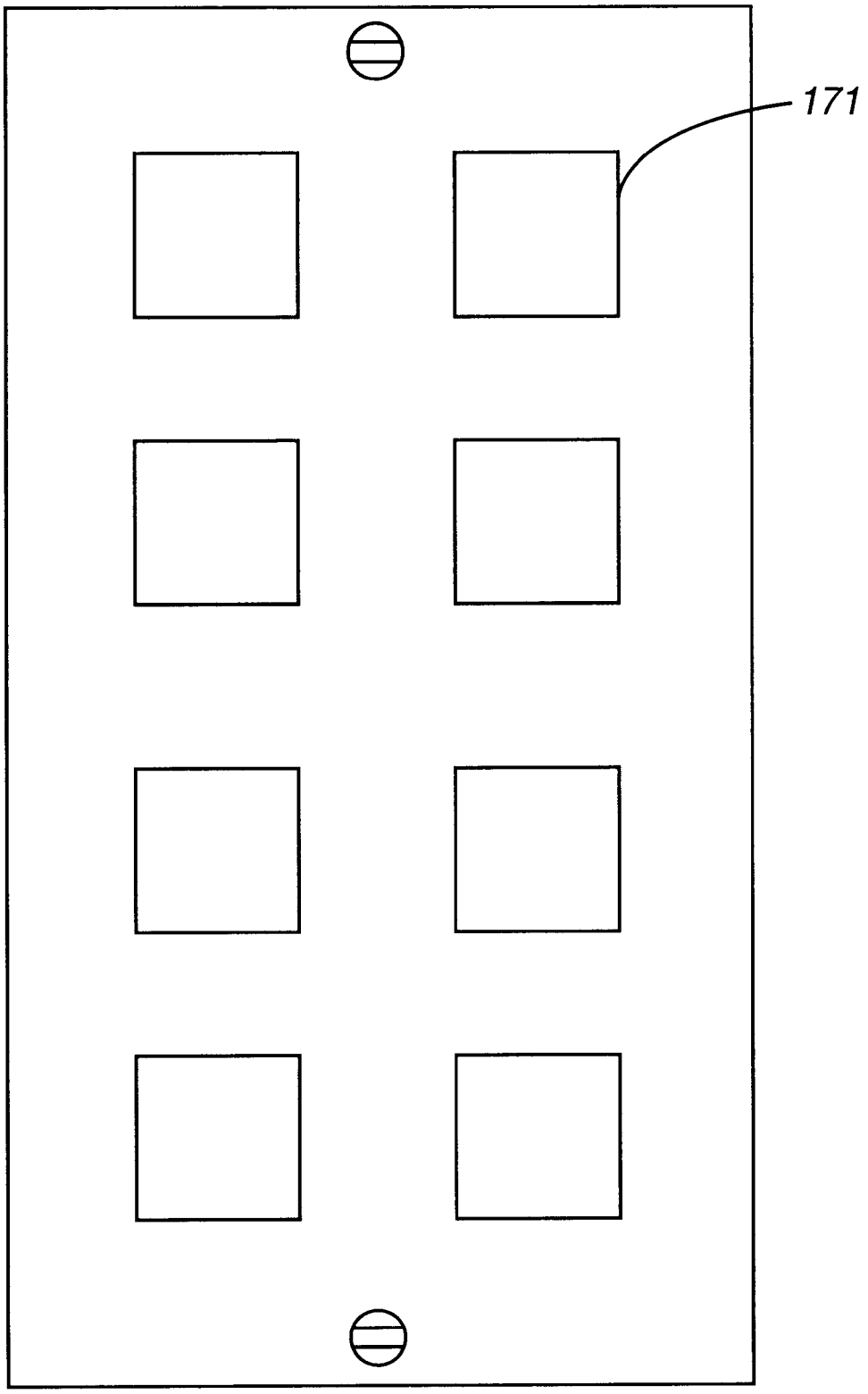

FIG. 11C shows an eight switch/circuit breaker electrical unit used with an electrical box 200 according to the present invention. The eight switch/breaker module can only be used in areas where 110 VAC service is used such as in the U.S. Each switch 171 depicted as a square in FIG. 11C is a push button switch that can optionally be lighted when on or off.

Figure 11E:
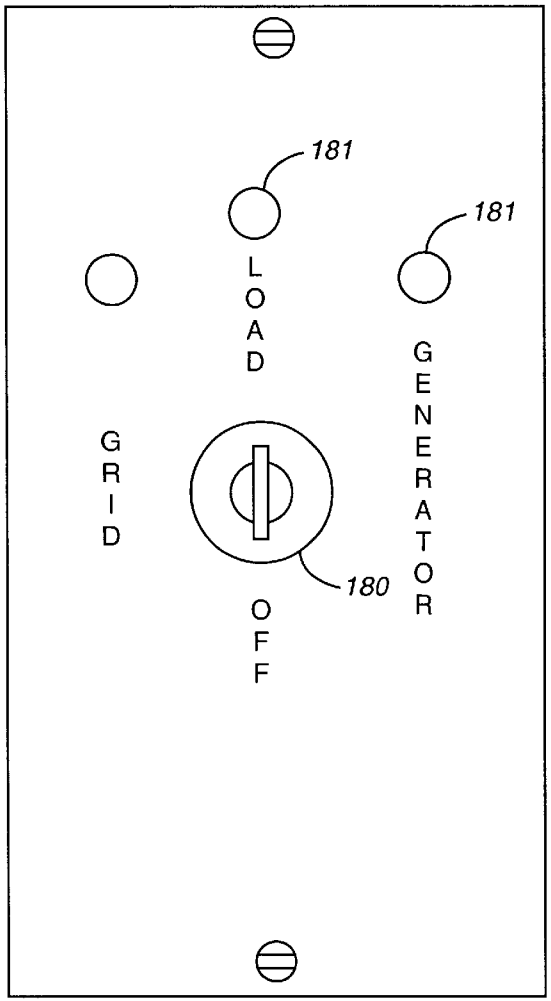
Figure 11D:
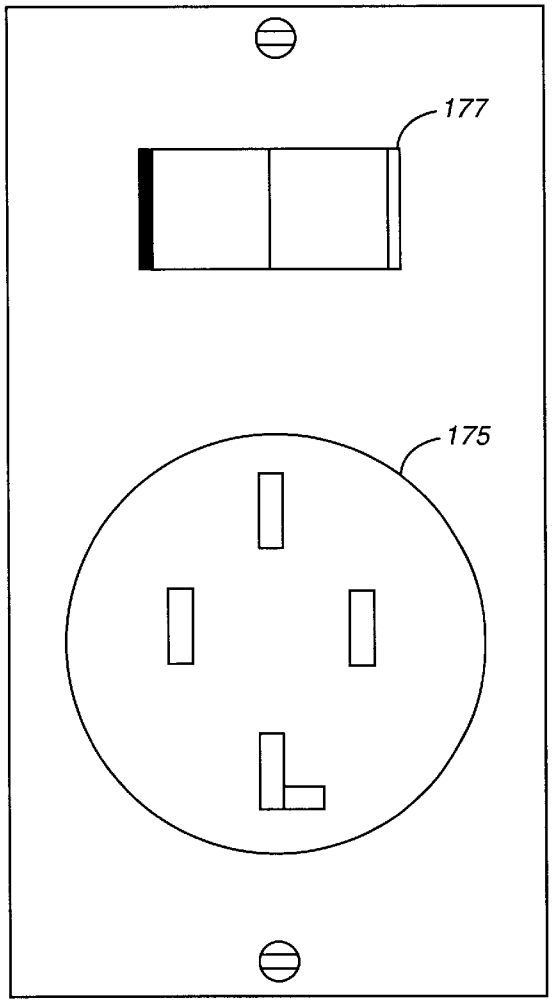

FIGS. 11D is a high current outlet 175 useful for clothes dryers, high power shop tools, and other high current applications. An optional circuit breaker 177 is shown above the outlets in the tripped position as described with respect to FIG. 11*c*. The electrical unit of FIG. 11D may also have ground fault circuit interrupt (GFCI) built into the circuit breaker and/or be lighted.

FIG. 11E is a transfer switch module with a three position, dual pole switch 180. The switch is shown in the off position. When pushed to one side or the other, a set of side bus bars of the electrical box 200 to which the unit is mated is connected to the center bus bars. Optional lamps 181 above each indicator show if the grid, the load, and the generator are energized. The transfer switch 180 can handle up to 60 A loads for a normal electrical box or up to 100 A loads for a high current electrical box. One side group of a the electrical box 200 is connected to the grid while the other side group is connected to the generator or other alternate power source. The center group will go to the load. A double pole double throw (DPDT) center off switch should be used to provide the transfer function. From these examples, it will be clear to one of ordinary skill in the art that an electrical unit that performs any one of a variety of known functions can be used in accordance with the present invention.

Figure 12:
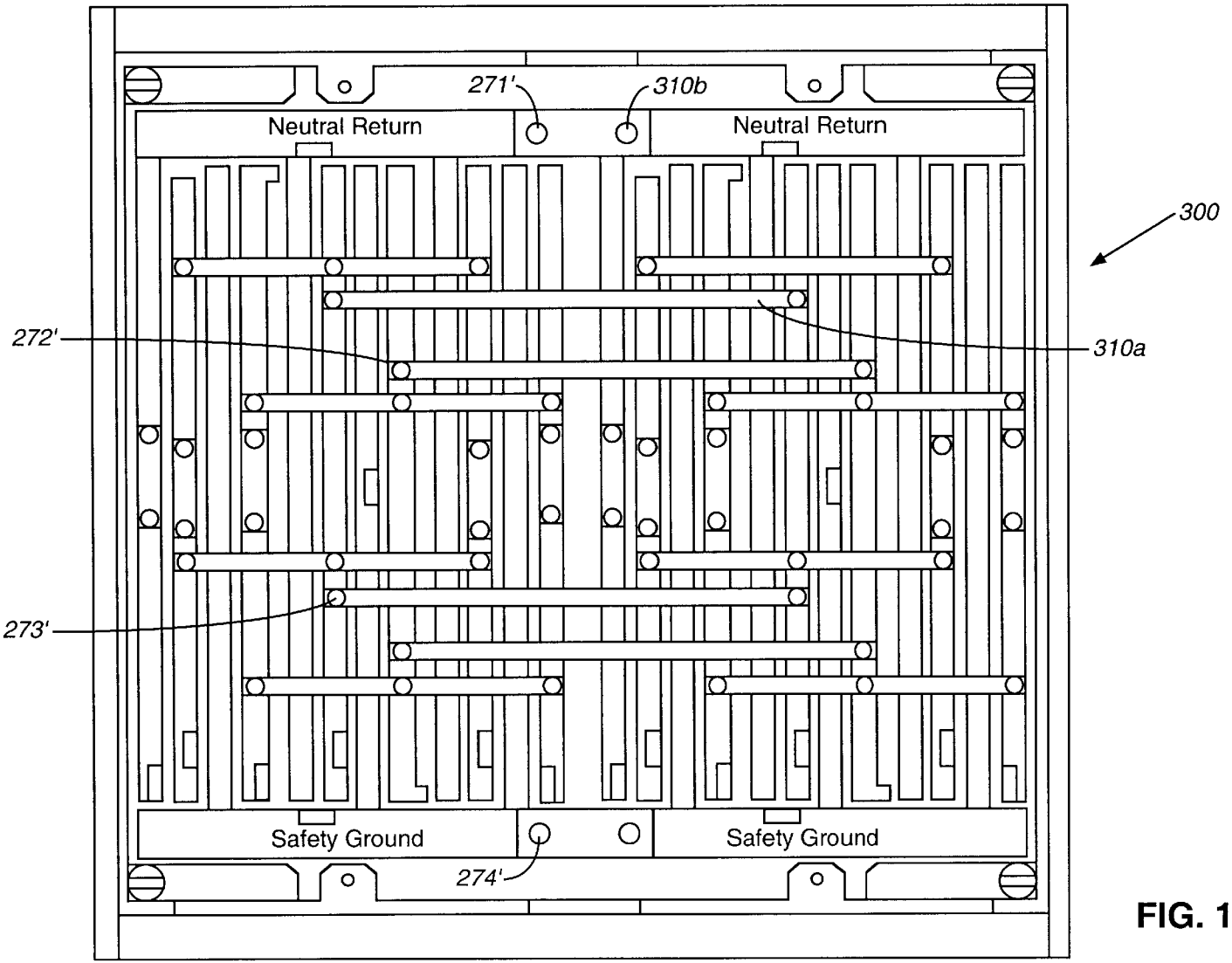
FIG. 12 is a front view of a multi gang electrical box in accordance with an embodiment of the present invention.

FIG. 12 is a front view of a multi-gang box 300 according to the present invention. The multigang box 300 is shown as two of the electrical boxes of FIG. 7 mounted adjacent to one another with the common sidewalls 209*b* and overlapping seating lips 241 removed from the electrical boxes so as to form a single cavity. While the gang box 300 is shown as an integral unit, the gang box 300 may be separate electrical boxes placed adjacent to one another and interconnected in accordance with the present invention to form a multi gang electrical box. In this situation, the adjacent sidewalls 209*b* may be removed or include openings through which interconnections between boxes may be made. Moreover, it is to be understood that any number of electrical boxes may be placed adjacent to one another and interconnected to form a multi-gang electrical box in accordance with the present invention. The multi-gang box 300 includes removable gang tabs 310 that span across gangs. The hot-to-hot or alternate hot to alternate hot gang tabs 310*a* are fixed to the screw holes 271–274 as discussed with respect to FIG. 7 and connect the black and red bus bars of the center groups of each electrical box together. The safety ground and neutral return horizontal bus bars are also connected across gangs with tabs. All the horizontal tabs can be removed if desired. All hot to hot horizontal tabs that span between gangs can carry 60 A and ground to ground horizontal tabs carry 100 A, even though the vertical bus bars are only capable of carrying 40 A to them. This is because the high current electrical box will also use the same horizontal tabs, thus saving on manufacturing costs by using the same design.

Obviously, numerous modifications and variations of the present invention are possible in light of the above teachings. It is therefore to be understood that within the scope of the appended claims, the invention may be practiced otherwise than as specifically described herein. For example, while the specification discloses that electrical connection is made by a socket and finger configuration, it is to be understood that a pin and socket configuration may also be used.

What is claimed is:

1. An electrical unit adapted to be disposed within an electrical box, comprising:

a body containing electrical circuitry of said electrical unit and having a device surface and a mating surface;

an electrical device arranged on said device surface and providing an electrical function to users of said electrical unit;

a neutral contact mounted on said mating surface and receiving a neutral conductive member of said electrical box; and a hot contact mounted on said mating surface and receiving a hot conductive member of said electrical box, wherein said neutral and hot contacts become electrically connected to said respective conductive members without the use of connecting wires when said electrical unit is disposed within said electrical box, said electrical box receives power from an external source over said neutral and hot conductive members, and said electrical box supplies power to said neutral and hot contacts of said electrical unit over said neutral and hot conductive members when said electrical unit is disposed within said electrical box.

2. The electrical unit of claim 1, wherein each of said neutral and hot electrical contacts comprises a rigid electrical socket that protrudes substantially perpendicularly from said mating surface.

3. The electrical unit of claim 2, wherein said electrical socket corresponding to said neutral contact is oriented in a first direction, said electrical socket corresponding to said hot contact is oriented in a second direction, and said electrical socket corresponding to said neutral contract mates with a neutral conductive member of said electrical box oriented in said first direction and said electrical socket corresponding to said hot contact mates with a hot conductive member of said electrical box oriented in said second direction.

4. The electrical unit of claim 1, further comprising a non-conductive member mounted on said mating surface and which prevents said electrical unit from mating with a non-compatible electrical box.

5. The electrical unit of claim 1, further comprising a mating screw mounted on said body and which mates with a screw hole on said electrical box, wherein tightening said mating screw in said screw hole causes said electrical unit to mate with said electrical box.

6. The electrical box of claim 5, further comprising a stop surface abutting a surface of said electrical box when said electrical unit is fully mated with said electrical box.

7. The electrical unit of claim 1, further comprising:

a ground contact mounted on said mating surface receiving a ground conductive member of said electrical box; and an alternative hot contact mounted on said mating surface receiving an alternative hot conductive member of said electrical box, wherein said ground and alternative hot contacts become electrically connected to said respective conductive members without the use of connecting wires when said electrical unit is mated with said electrical box.

8. The electrical unit of claim 1, wherein said electrical device comprises an electrical outlet providing electrical power to appliances plugged therein.

9. The electrical unit of claim 8, wherein said electrical outlet comprises a high power electrical outlet and said electrical device further comprises a circuit interrupt switch interrupting power provided to said high power electrical outlet.

10. The electrical unit of claim 1, wherein said electrical device comprises an electrical switch.

11. The electrical unit of claim 10, wherein said electrical switch comprises one of a push button switch and a toggle switch.

12. The electrical unit of claim 1, wherein said electrical device comprises a transfer switch.

13. The electrical unit of claim 1, wherein said electrical device comprises a circuit breaker.

14. An electrical unit adapted to be disposed within an electrical box, comprising:

a means for containing electrical circuitry of said electrical unit, said means for containing having a mating surface and a device surface;

a means, provided on said device surface, for providing an electrical function to users of said electrical unit;

a means, mounted on said mating surface, for receiving a neutral conductive member of said electrical box; and a means, mounted on said mating surface, for receiving a hot conductive member of said electrical box, wherein said means for receiving a neutral conductive member, and said means for receiving a hot conductive member become electrically connected to said respective conductive members without the use of connecting wires when said electrical unit is disposed within said electrical box, said electrical box receives power from an external means over said neutral and hot conductive members, and said electrical box supplies power to said electrical unit over said neutral and hot conductive members when said electrical unit is disposed within said electrical box.

15. The electrical unit of claim 14, further comprising means for keying said means for receiving a neutral conductive member and said means for receiving a hot conductive member to receive only a respective conductive member on said electrical box.

16. The electrical unit of claim 14, further comprising means for preventing a non-compatible electrical box from mating with said electrical unit.

17. The electrical unit of claim 14, further comprising means for fastening said electrical unit to said electrical box.

18. The electrical unit of claim 14, wherein said means for providing an electrical function comprises means for providing electrical power to an appliance.

19. The electrical unit of claim 18, wherein said means for providing an electrical function further comprises means for interrupting said electrical power to said appliance.

20. The electrical unit of claim 14, wherein said means for providing an electrical function comprises means for switching electrical power.

21. The electrical unit of claim 14, wherein said means for providing an electrical function comprises means for interrupting electrical power to a circuit.

22. The electrical unit of claim 14, further comprising:

means, mounted on said mating surface, for receiving a ground conductive member of said electrical box; and a means, mounted on said mating surface, for receiving an alternative hot conductive member of said electrical box, wherein said means for receiving a ground conductive member, and said means for receiving an alternative hot conductive member become electrically connected to said respective conductive members without the use of connecting wires when said electrical unit is mated with said electrical box.

23. An electrical unit adapted to be disposed within an electrical junction box, comprising:

a body having a device surface and a mating surface;

an electrical device arranged on said device surface and providing an electrical function to users of said electrical unit; and contacts mounted on said mating surface and receiving respective conductive members of said electrical junction box; and wherein said contacts become electrically and removably connected to said conductive members when said electrical unit is disposed within said electrical junction box, said electrical junction box receives power from an external source over said conductive members, and said electrical junction box supplies power to said contacts of said electrical unit over said conductive members when said electrical unit is removably disposed within said electrical junction box.

24. The electrical unit of claim 23, wherein said contacts comprise rigid electrical sockets corresponding to neutral and hot conductors of said electrical unit and adapted to be mated with said conductive members comprising rigid electrical prongs corresponding to neutral and hot conductors of said electrical junction box, and said neutral and hot conductors of said electrical unit are oriented in directions perpendicular to each other and adapted to be mated with said neutral and hot conductors of said electrical junction box oriented in directions perpendicular to each other and so as to mate with said neutral and hot conductors of said electrical unit.

25. An electrical unit adapted to be disposed within a box mounted on a frame of a building, comprising:

a body having a device surface and a mating surface;

an electrical device arranged on said device surface and providing an electrical function to users of said electrical unit; and contacts mounted on said mating surface and receiving respective conductive members of said box; and wherein said contacts become electrically and removably connected to said conductive members when said electrical unit is disposed within said box, said box receives power from an external source over said conductive members, and said box supplies power to said contacts of said electrical unit over said conductive members when said electrical unit is removably disposed within said box.

26. The electrical unit of claim 25, wherein said contacts comprise rigid electrical sockets corresponding to neutral and hot conductors of said electrical unit and adapted to be mated with said conductive members comprising rigid electrical prongs corresponding to neutral and hot conductors of said box, and said neutral and hot conductors of said electrical unit are oriented in directions perpendicular to each other and adapted to be mated with said neutral and hot conductors of said electrical box oriented in directions perpendicular to each other and so as to mate with said neutral and hot conductors of said electrical unit.

* * * * *